US012466595B2

(12) United States Patent
Yang et al.

(10) Patent No.: US 12,466,595 B2
(45) Date of Patent: Nov. 11, 2025

(54) VACUUM KIT ADAPTED FOR A CONTAINER AND RELATED VACUUM PRODUCT

(71) Applicant: Universal Trim Supply Co., Ltd., New Taipei (TW)

(72) Inventors: Shih-Sheng Yang, Taipei (TW); Chih-Wei Yang, Taipei (TW); Po-Jen Chen, Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 92 days.

(21) Appl. No.: 18/433,488

(22) Filed: Feb. 6, 2024

(65) Prior Publication Data

US 2025/0250044 A1 Aug. 7, 2025

(51) Int. Cl.
*B65B 31/04* (2006.01)

(52) U.S. Cl.
CPC ..... *B65B 31/04* (2013.01)

(58) Field of Classification Search
CPC ..... B65B 31/04
See application file for complete search history.

(56) References Cited

U.S. PATENT DOCUMENTS

2003/0015452 A1 1/2003 Su
2006/0201576 A1 9/2006 Domenig
2006/0254219 A1 11/2006 Alipour
2009/0078895 A1* 3/2009 Beaulieu ..... F16K 1/54 251/35
2009/0162941 A1 6/2009 Winkler
2016/0264338 A1* 9/2016 Growden ..... B65B 7/025
2020/0399042 A1 12/2020 Yang

FOREIGN PATENT DOCUMENTS

CN 112373927 A 2/2021
EP 2 703 303 A2 3/2014
JP 2008-526638 A 7/2008

* cited by examiner

*Primary Examiner* — Thomas M Wittenschlaeger
(74) *Attorney, Agent, or Firm* — Winston Hsu

(57) ABSTRACT

A vacuum kit adapted for a container is provided and includes a vacuum device and a liquid receiver detachably assembled with the vacuum device. The liquid receiver includes a receiving case, a sealing component and a buoyant device. The sealing component is disposed adjacent to an outlet of the receiving case. The buoyant device is movable between an initial position and a clamping position relative to the receiving case. After the buoyant device is driven by the liquid flowing out of the container to move from the initial position to an actuating position between the initial position and the clamping position, the buoyant device can be driven by a magnetic force to move from the actuating position to the clamping position to clamp the sealing component by the buoyant device and the receiving case for sealing the outlet of the receiving case. Besides, a related vacuum product is also provided.

20 Claims, 21 Drawing Sheets

VACUUM KIT ADAPTED FOR A CONTAINER AND RELATED VACUUM PRODUCT

BACKGROUND OF THE INVENTION

1. Field of the Invention

The present invention relates to a vacuum device and a related vacuum product, and more specifically, to a vacuum kit adapted for a container and a related vacuum product.

2. Description of the Prior Art

With advancement of technology and development of economy, there are more and more consumer goods available in the market. For example, a conventional vacuum system usually includes a bag and a vacuum device. The bag can be used for accommodating food. The vacuum device can discharge air inside the bag to extend storage time and reduce storage volume. However, during air discharge, liquid inside the bag might flow out of the bag and enter into the vacuum device easily, and it probably causes a liquid damage of the vacuum device.

SUMMARY OF THE INVENTION

It is an objective of the present invention to provide a vacuum kit adapted for a container and a related vacuum product for solving the aforementioned problem.

In order to achieve the aforementioned objective, the present invention discloses a vacuum kit adapted for a container. The vacuum kit includes a vacuum device and a liquid receiver. The liquid receiver is detachably assembled with the vacuum device. The liquid receiver includes a receiving case, a sealing component and a buoyant device. The receiving case includes an inlet and an outlet. The sealing component is disposed adjacent to the outlet of the receiving case. The buoyant device is movable between an initial position and a clamping position relative to the receiving case. The buoyant device includes a buoyant assembly and a magnetic component. The buoyant assembly is at least partially movably received in the receiving case. The magnetic component is engaged with the buoyant assembly. The magnetic component is configured to provide a magnetic force when the vacuum device and the liquid receiver are assembled with each other. When the buoyant device is located at the initial position, the magnetic force does not drive the buoyant device to move away from the initial position. After the buoyant device is driven by the liquid flowing out of the container to move from the initial position to an actuating position between the initial position and the clamping position, the magnetic force drives the buoyant device to move from the actuating position to the clamping position to clamp the sealing component by the buoyant device and the receiving case for sealing the outlet of the receiving case.

According to an embodiment of the present invention, the receiving case further includes an upper case portion and a lower case portion detachably assembled with the upper case portion. The inlet is formed on the lower case portion, and the outlet is formed on the upper case portion.

According to an embodiment of the present invention, the liquid receiver further includes at least one auxiliary sealing component configured to be engaged between the upper case portion and the lower case portion, between the vacuum device and the receiving case and/or between the receiving case and the container.

According to an embodiment of the present invention, a first cooperating structure is formed on the vacuum device, and a second cooperating structure is formed on the receiving case for cooperating with the first cooperating structure for facilitating assembly of the vacuum device and the liquid receiver.

According to an embodiment of the present invention, the buoyant assembly includes a first buoyant component and a second buoyant component detachably assembled with the first buoyant component. The second buoyant component is formed in a circular disc shape, and the first buoyant component includes a main body portion and at least one extending portion extending from the main body portion and passing through the second buoyant component.

According to an embodiment of the present invention, the magnetic component is disposed between the first buoyant component and the second buoyant component or at least partially disposed inside the first buoyant component.

According to an embodiment of the present invention, a guiding structure is formed on the receiving case and configured to cooperate with the at least one extending portion for guiding the buoyant assembly.

According to an embodiment of the present invention, the vacuum device includes a vacuum pump, a controller and a pressure sensor. The controller is electrically connected to the vacuum pump. The pressure sensor is electrically connected to the controller and for actuating the controller to control the vacuum pump according to a sensing result of the pressure sensor.

According to an embodiment of the present invention, the liquid receiver further includes at least one auxiliary sealing component configured to be engaged between the vacuum device and the receiving case and/or between the receiving case and the container.

In order to achieve the aforementioned objective, the present invention further discloses a vacuum product. The vacuum product includes a container and a vacuum kit. The container includes a containing body, a valve seat and a one-way valve. The valve seat is disposed on the containing body. The one-way valve is disposed on the valve seat. The vacuum kit includes a vacuum device and a liquid receiver. The liquid receiver is detachably assembled with the vacuum device. The liquid receiver includes a receiving case, a sealing component and a buoyant device. The receiving case includes an inlet and an outlet. The sealing component is disposed adjacent to the outlet of the receiving case. The buoyant device is movable between an initial position and a clamping position relative to the receiving case. The buoyant device includes a buoyant assembly and a magnetic component. The buoyant assembly is at least partially movably received in the receiving case. The magnetic component is engaged with the buoyant assembly. The magnetic component is configured to provide a magnetic force when the vacuum device and the liquid receiver are assembled with each other. When the buoyant device is located at the initial position, the magnetic force does not drive the buoyant device to move away from the initial position. After the buoyant device is driven by the liquid flowing out of the container to move from the initial position to an actuating position between the initial position and the clamping position, the magnetic force drives the buoyant device to move from the actuating position to the clamping position to clamp the sealing component by the buoyant device and the receiving case for sealing the outlet of the receiving case.

According to an embodiment of the present invention, a first mating structure is formed on the receiving case, and a second mating structure is formed on the valve seat and configured to cooperate with the first mating structure for aligning the receiving case with the valve seat.

According to an embodiment of the present invention, the container further includes a filtering component disposed on the valve seat and configured to filter particles.

According to an embodiment of the present invention, the receiving case further includes an upper case portion and a lower case portion detachably assembled with the upper case portion. The inlet is formed on the lower case portion, and the outlet is formed on the upper case portion.

According to an embodiment of the present invention, the liquid receiver further includes at least one auxiliary sealing component configured to be engaged between the upper case portion and the lower case portion, between the vacuum device and the receiving case and/or between the receiving case and the valve seat of the container.

According to an embodiment of the present invention, a first cooperating structure is formed on the vacuum device, and a second cooperating structure is formed on the receiving case for cooperating with the first cooperating structure for facilitating assembly of the vacuum device and the liquid receiver.

According to an embodiment of the present invention, the buoyant assembly includes a first buoyant component and a second buoyant component detachably assembled with the first buoyant component. The second buoyant component is formed in a circular disc shape, and the first buoyant component includes a main body portion and at least one extending portion extending from the main body portion and passing through the second buoyant component.

According to an embodiment of the present invention, the magnetic component is disposed between the first buoyant component and the second buoyant component or at least partially disposed inside the first buoyant component.

According to an embodiment of the present invention, a guiding structure is formed on the receiving case and configured to cooperate with the at least one extending portion for guiding the buoyant assembly.

According to an embodiment of the present invention, the vacuum device includes a vacuum pump, a controller and a pressure sensor. The controller is electrically connected to the vacuum pump. The pressure sensor is electrically connected to the controller and for actuating the controller to control the vacuum pump according to a sensing result of the pressure sensor.

According to an embodiment of the present invention, the liquid receiver further includes at least one auxiliary sealing component configured to be engaged between the vacuum device and the receiving case and/or between the receiving case and the valve seat of the container.

In summary, the liquid receiver of the present invention is configured to clamp the sealing component by the buoyant device and the receiving case for sealing the outlet of the receiving case, so as to prevent liquid flowing out of the container from entering into the vacuum device. Therefore, the present invention can effectively prevent a liquid damage of the vacuum device.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
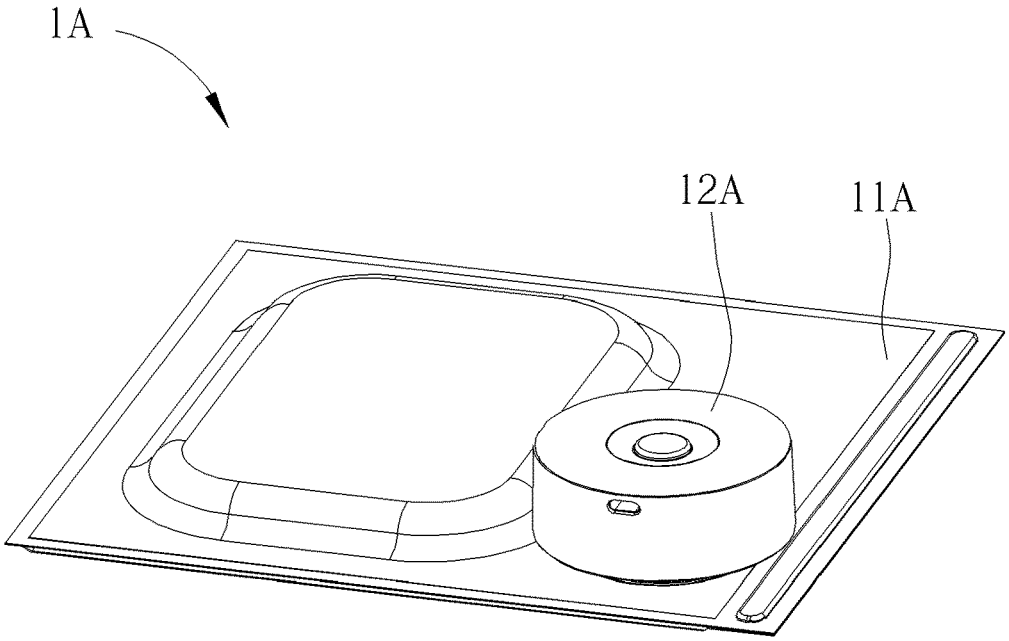
FIG. 1 is a schematic diagram of a vacuum product according to a first embodiment of the present invention.
Figure 2:
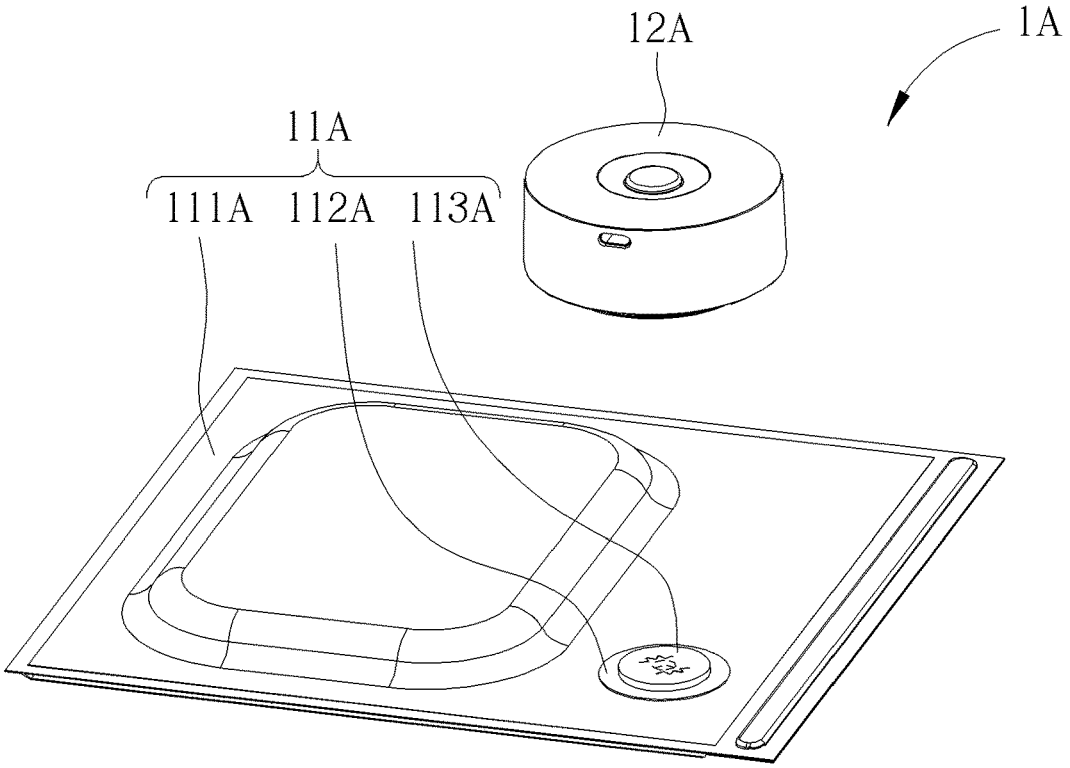
FIG. 2 is an exploded diagram of the vacuum product according to the first embodiment of the present invention.
Figure 3:
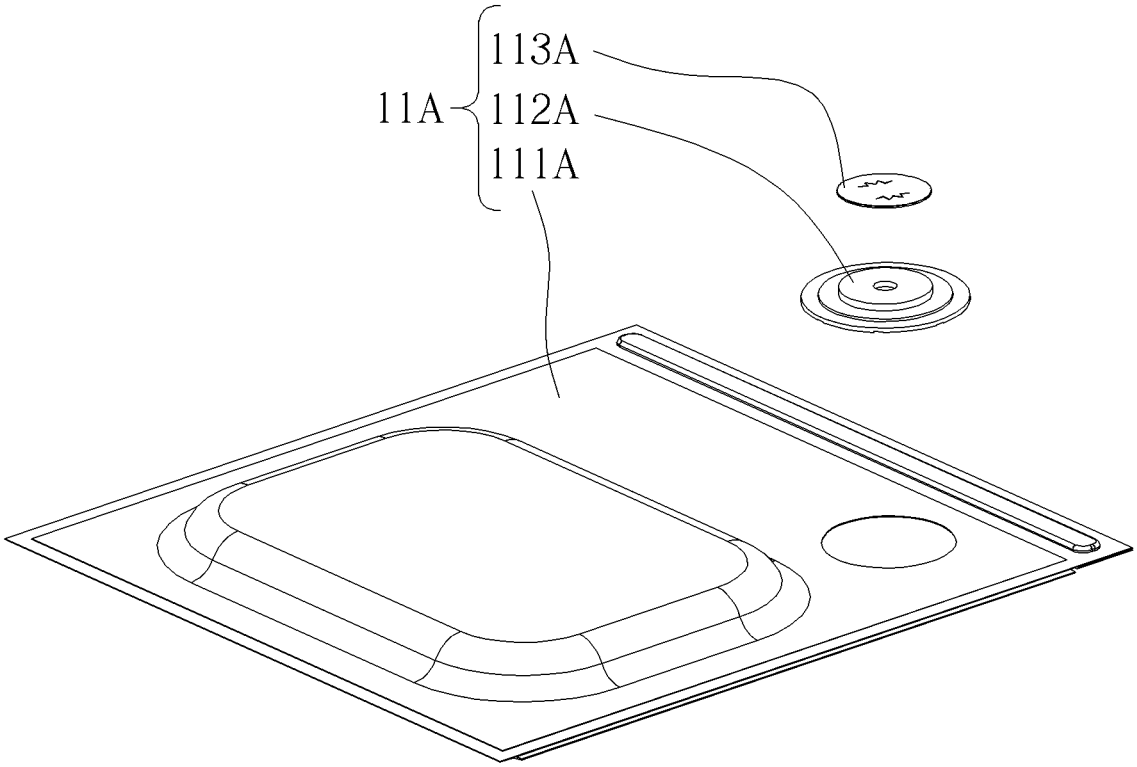
FIG. 3 is an exploded diagram of a container according to the first embodiment of the present invention.
Figure 4:
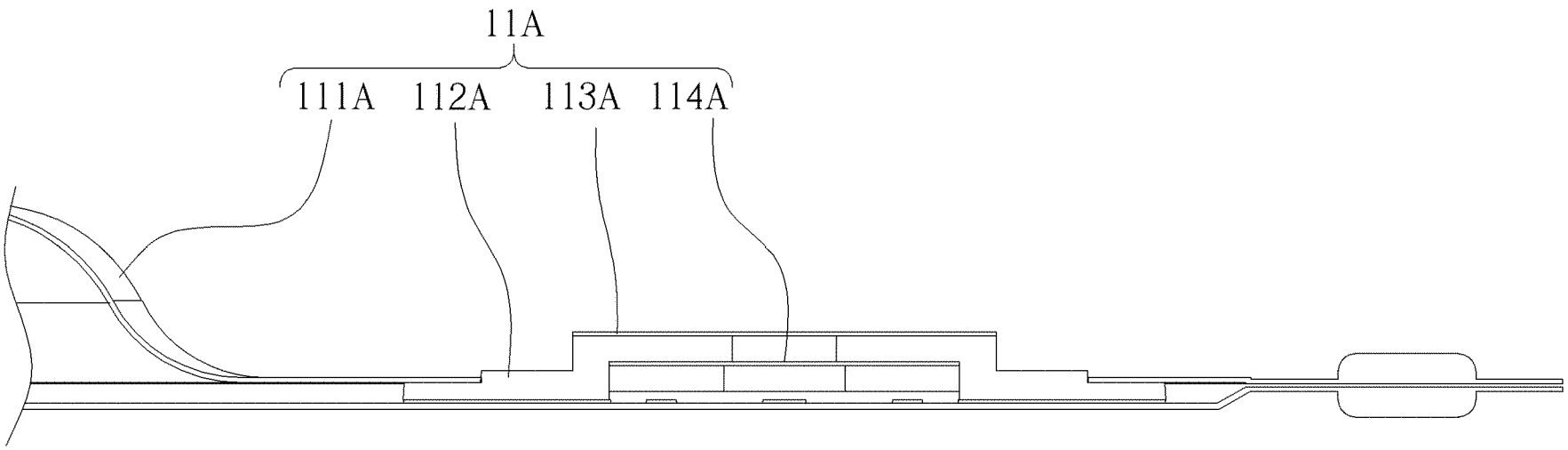
FIG. 4 is a partial sectional diagram of the container according to the first embodiment of the present invention.

Please refer to FIG. 1 to FIG. 4. FIG. 1 is a schematic diagram of a vacuum product 1A according to a first embodiment of the present invention. FIG. 2 is an exploded diagram of the vacuum product 1A according to the first embodiment of the present invention. FIG. 3 is an exploded diagram of a container 11A according to the first embodiment of the present invention. FIG. 4 is a partial sectional diagram of the container 11A according to the first embodiment of the present invention. As shown in FIG. 1 to FIG. 4, the vacuum product 1A includes the container 11A and a vacuum kit 12A. The container 11A includes a containing body 111A, a valve seat 112A and a one-way valve 113A. The containing body 111A is configured to accommodate food or any other object. The valve seat 112A is disposed on the containing body 111A. The one-way valve 113A is disposed on the valve seat 112A. The vacuum kit 12A is configured to discharge air inside the containing body 111A. The one-way valve 113A is configured to allow the air inside the containing body 111A to be drawn out of the container 11A through the valve seat 112A and the one-way valve 113A by the vacuum kit 12A and prevent ambient air from entering into the containing body 111A through the valve seat 112A.

In this embodiment, the containing body 111A and the one-way valve 113A can be a flexible sealing bag and a sticker-type one-way valve 113A adhesively attached on the valve seat 112A, respectively. However, the present invention is not limited to this embodiment. For example, in another embodiment, the containing body can be a hard box or a hard jar, and the one-way valve can be a rubber umbrella valve. Alternatively, in another embodiment, the valve seat can be omitted, the containing body and the one-way valve can be a flexible sealing bag and a sticker-type one-way valve adhesively attached on the containing body directly, respectively.

Furthermore, in this embodiment, as shown in FIG. 4, the container 11A further includes a filtering component 114A disposed on the valve seat 112A and configured to filter particles for preventing the one-way valve 113A from being damaged by the particles. Specifically, the filtering component 114A can be made of mesh fabric and disposed on the valve seat 112A by overmolding. However, the present invention is not limited to this embodiment. For example, in another embodiment, the filtering component can be omitted.

Figure 5:
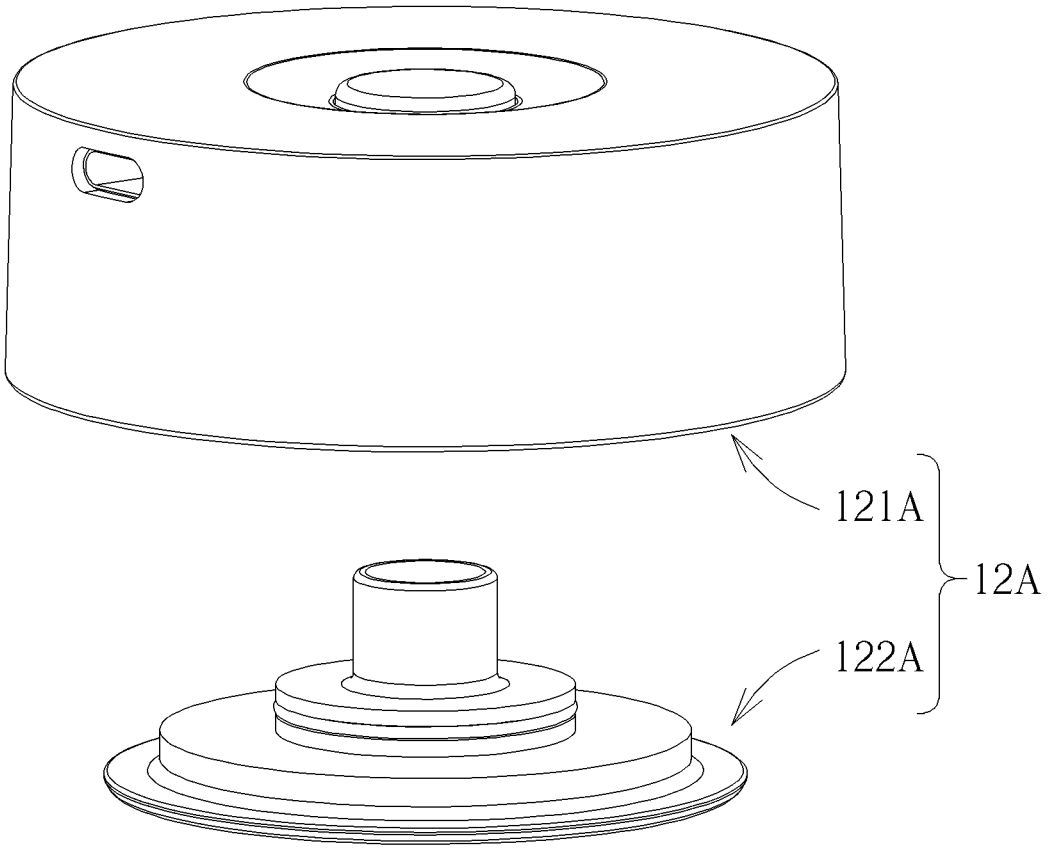
FIG. 5 is a diagram of a vacuum kit as a vacuum device is detached from a liquid receiver according to the first embodiment of the present invention.
Figure 6:
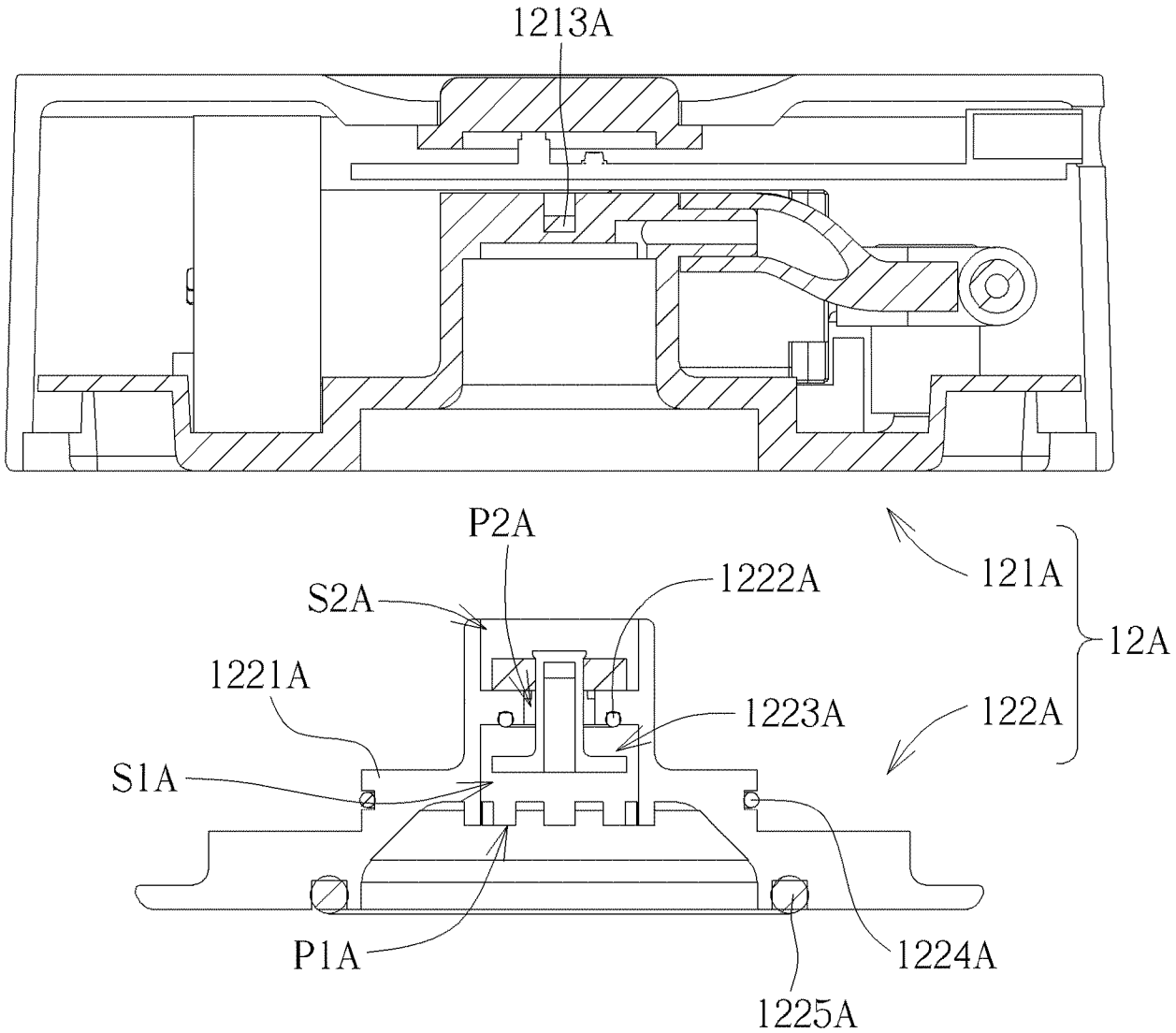
FIG. 6 is an internal structural diagram of the vacuum kit as the vacuum device is detached from the liquid receiver according to the first embodiment of the present invention.
Figure 7:
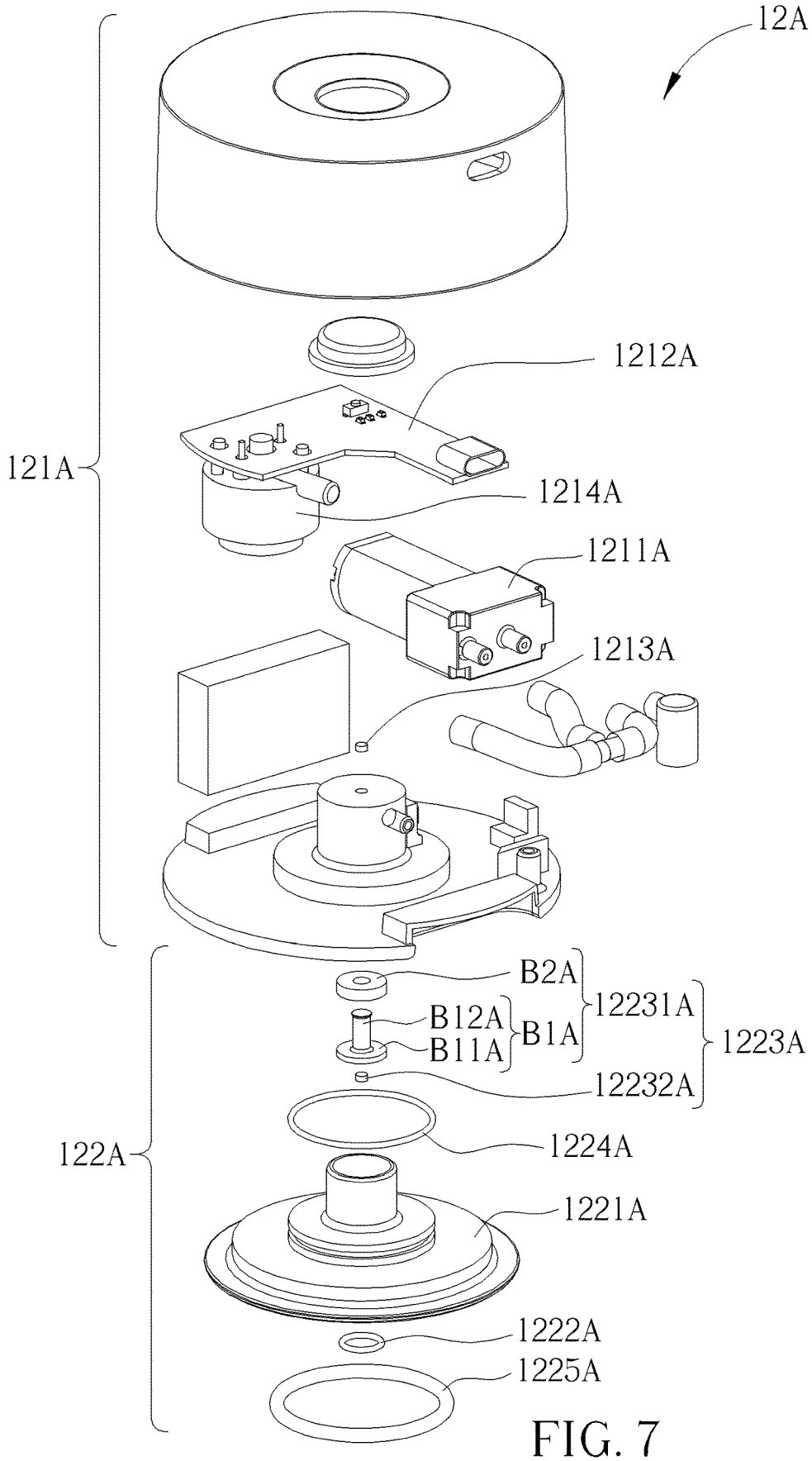
FIG. 7 is an exploded diagram of the vacuum kit according to the first embodiment of the present invention.
Figure 8:
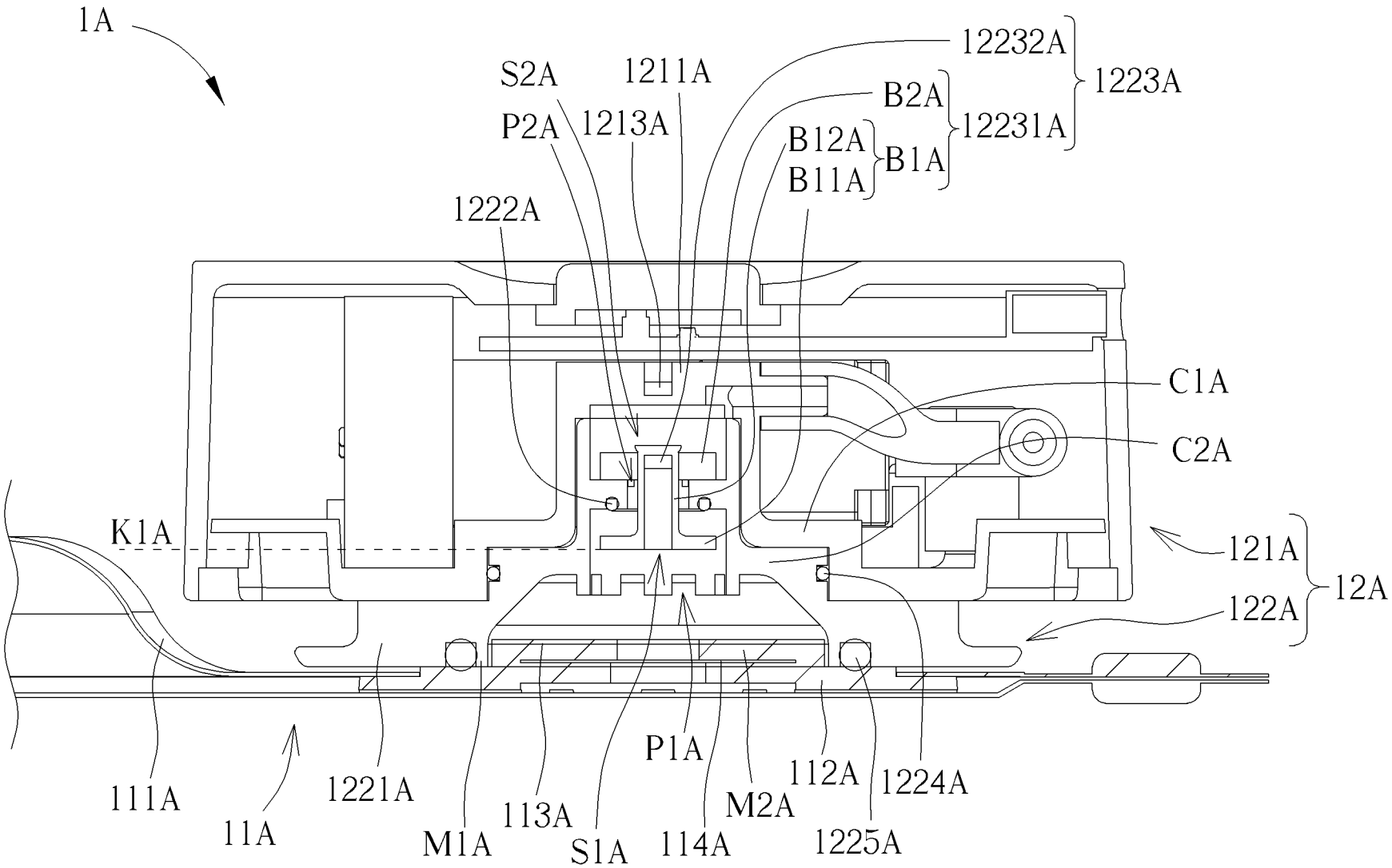
FIG. 8 is a diagram of the vacuum product as a buoyant device is located at an initial position according to the first embodiment of the present invention.
Figure 9:
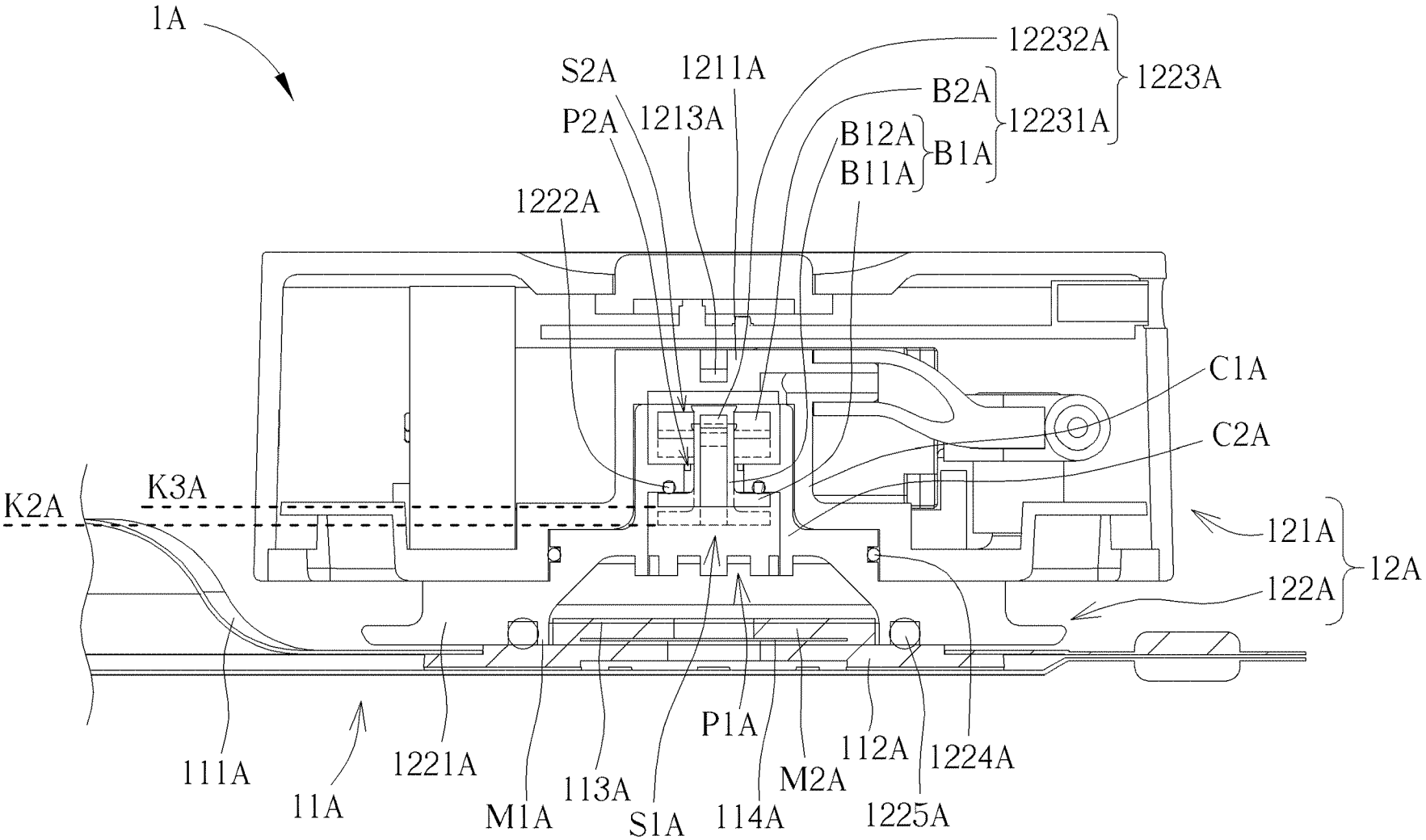
FIG. 9 is a diagram of the vacuum product as the buoyant device is located at a clamping position according to the first embodiment of the present invention.
Figure 10:
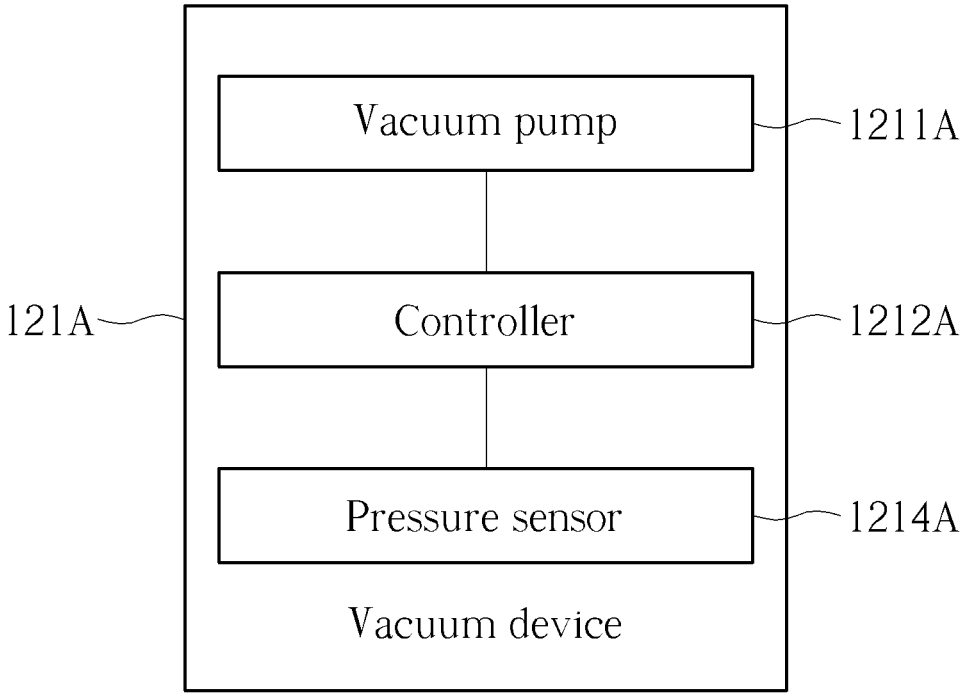
FIG. 10 is a functional block diagram of the vacuum device according to the first embodiment of the present invention.

Please refer to FIG. 5 to FIG. 10. FIG. 5 is a diagram of the vacuum kit 12A as a vacuum device 121A is detached from a liquid receiver 122A according to the first embodiment of the present invention. FIG. 6 is an internal structural diagram of the vacuum kit 12A as the vacuum device 121A is detached from the liquid receiver 122A according to the first embodiment of the present invention. FIG. 7 is an exploded diagram of the vacuum kit 12A according to the first embodiment of the present invention. FIG. 8 is a diagram of the vacuum product 1A as a buoyant device 1223A is located at an initial position K1A according to the first embodiment of the present invention. FIG. 9 is a diagram of the vacuum product 1A as the buoyant device 1223A is located at a clamping position K3A according to the first embodiment of the present invention. FIG. 10 is a functional block diagram of the vacuum device 121A according to the first embodiment of the present invention. As shown in FIG. 5 to FIG. 10, the vacuum kit 12A includes the vacuum device 121A and the liquid receiver 122A. The vacuum device 121A includes a vacuum pump 1211A configured to draw the air inside the containing body 111A out of the container 11A, and a controller 1212A electrically connected to the vacuum pump 1211A and configured to control the vacuum pump 1211A. In this embodiment, the controller 1212A can be a controlling circuit board. However, the present invention is not limited to this embodiment. The liquid receiver 122A is detachably assembled with the vacuum device 121A. The liquid receiver 122A includes a receiving case 1221A, a sealing component 1222A and the buoyant device 1223A. The receiving case 1221A is configured to detachably engage with the valve seat 112A and includes an inlet P1A and an outlet P2A. The sealing component 1222A is disposed adjacent to the outlet P2A of the receiving case 1221A. The buoyant device 1223A is movable relative to the receiving case 1221A between the initial position KIA as shown in FIG. 8 and the clamping position K3A as shown in FIG. 9. The buoyant device 1223A includes a buoyant assembly 12231A and a magnetic component 12232A. The buoyant assembly 12231A is at least partially movably received in the receiving case 1221A. The magnetic component 12232A is engaged with the buoyant assembly 12231A. The magnetic component 12232A is configured to cooperate with a magnetically attractive component 1213A on the vacuum device 121A, so as to produce magnetic attraction, i.e., the magnetic component 12232A is configured to provide a magnetically attractive force, when the vacuum device 121A and the liquid receiver 122A are assembled with each other. The buoyant device 1223A can be driven to move by liquid flowing out of the container 11A and/or the magnetic attraction. As shown in FIG. 8, when the buoyant device 1223A is located at the initial position K1A, i.e., when there is no liquid flowing out of the container 11A, there is not enough magnetic attraction to overcome a gravity force due to an excessively long distance between the magnetic component 12232A and the magnetically attractive component 1213A on the vacuum device 121A, such that the buoyant device 1223A is not driven by the magnetically attractive force to move away from the initial position K1A. During air discharge, the liquid flowing out of the container 11A can drive the buoyant device 1223A to move away from the initial position K1A due to a buoyant force. As shown in FIG. 9, after the buoyant device 1223A is driven by the liquid flowing out of the container 11A to move from the initial position K1A to an actuating position K2A between the initial position K1A and the clamping position K3A, the magnetic attraction is strong enough to overcome the gravity force due to a reduced distance between the magnetic component 12232A and the magnetically attractive component 1213A on the vacuum device 121A, such that the buoyant device 1223A is driven by the magnetically attracting force to move from the actuating position K2A to the clamping position K3A to clamp the sealing component 1222A by the buoyant device 1223A and the receiving case 1221A for sealing the outlet P2A of the receiving case 1221A. Such configuration effectively prevents the liquid flowing out of the container 11A from overflowing from the liquid receiver 122A into the vacuum device 121A, so as to prevent a liquid damage of the vacuum device 121A.

It should be noticed that, after the vacuum device 121A is detached from the liquid receiver 122A, the buoyant device 1223A can be driven to move back to the actuating position K2A away from the clamping position K3A by the gravity force for unsealing the outlet P2A of the receiving case 1221A.

In this embodiment, the magnetic component 12232A and the magnetically attractive component 1213A can be two permanent magnets. However, the present invention is not limited to this embodiment. For example, in another embodiment, the magnetic component and the magnetically attractive component can be a permanent magnet and a ferromagnetic component, respectively.

In order to facilitate engagement of the receiving case 1221A and the valve seat 112A, as shown in FIG. 2 to FIG. 4 and FIG. 6 to FIG. 9, a first mating structure MIA is formed on the receiving case 1221A, and a second mating structure M2A is formed on the valve seat 112A and configured to cooperate with the first mating structure MIA for aligning the receiving case 1221A with the valve seat 112A. In this embodiment, the first mating structure MIA can be a mating recessed structure, and the second mating structure M2A can be a mating protruding structure configured to be inserted into the first mating structure MIA. However, the present invention is not limited to this embodiment. For example, in another embodiment, the first mating structure and the second mating structure can be a mating protruding structure and a mating recessed structure, respectively.

In order to facilitate assembly of the vacuum device 121A and the liquid receiver 122A, as shown in FIG. 5 to FIG. 9, a first cooperating structure C1A is formed on the vacuum device 121A, and a second cooperating structure C2A is formed on the receiving case 1221A for cooperating with the first cooperating structure CIA. In this embodiment, the first cooperating structure CIA can be a cooperating recessed structure, and the second cooperating structure C2A can be a cooperating protruding structure and configured to be inserted into the first cooperating structure CIA. However, the present invention is not limited to this embodiment. For example, in another embodiment, the first cooperating structure and the second cooperating structure can be a cooperating protruding structure and a cooperating recessed structure, respectively.

Furthermore, as shown in FIG. 6 to FIG. 9, a first receiving space S1A and a second receiving space S2A are formed on the receiving case 1221A. The inlet P1A is communicated with the first receiving space S1A, and the outlet P2A is communicated between the first receiving space S1A and the second receiving space S2A. The liquid flowing out of the container 11A can flow into the first receiving space S1A through the inlet PA and then flow into the second receiving space S2A through the outlet P2A when the outlet P2A is unsealed. The sealing component 1222A is disposed on a wall of the receiving case 1221A and located adjacent to the first receiving space S1A. The buoyant assembly 12231A includes a first buoyant component B1A and a second buoyant component B2A detachably assembled with the first buoyant component BIA. The second buoyant component B2A is formed in a circular disc shape and received in the second receiving space S2A, and the first buoyant component B1A includes a main body portion B11A and an extending portion B12A extending from the main body portion B11A and passing through the second buoyant component B2A. The main body portion B11A is received in the first receiving space S1A and configured to abut against the sealing component 1222A. In other words, the main body portion B11A is located at a side of the second buoyant component B2A adjacent to the inlet P1A of the receiving case 1221A, and the extending portion B12A extends from the main body portion B11A away from the inlet P1A of the receiving case 1221A. The magnetic component 12232A is at least partially disposed inside a distal end of the extending portion B12A of the first buoyant component B1A away from the main body portion B11A.

In this embodiment, the second buoyant component B2A can be made of foam material, so as to ensure the buoyant device 1223A to be moved from the initial position K1A to the clamping position K3A through the actuating position K2A for sealing the outlet P2A before the liquid overflows from the second receiving space S2A. However, the present invention is not limited to this embodiment. For example, in another embodiment, the second buoyant component can be a plastic pontoon.

Preferably, as shown in FIG. 6 to FIG. 9, the liquid receiver 122A further includes a first auxiliary sealing component 1224A and a second auxiliary sealing component 1225A. The first auxiliary sealing component 1224A is disposed on the receiving case 1221A and configured to be engaged between the vacuum device 121A and the receiving case 1221A for preventing any leakage through a gap between the vacuum device 121A and the receiving case 1221A. The second auxiliary sealing component 1225A is disposed on the receiving case 1221A and configured to be engaged between the receiving case 1221A and the valve seat 112A of the container 11A for preventing any leakage through a gap between the receiving case 1221A and the valve seat 112A of the container 11A. However, the present invention is not limited to this embodiment. For example, in another embodiment, the first auxiliary sealing component can be disposed on the vacuum device, and the second auxiliary sealing component can be disposed on the valve seat. Alternatively, in another embodiment, at least one of the first auxiliary sealing component and the second auxiliary sealing component can be omitted.

Besides, as shown in FIG. 7 and FIG. 10, in this embodiment, the vacuum device 121A further includes a pressure sensor 1214A. The pressure sensor 1214A is electrically connected to the controller 1212A and configured to sense a pressure of a suction end of the vacuum pump 1211A. When the buoyant device 1223A is located at the clamping position K3A, i.e., when the sealing component 1222A is clamped by the buoyant device 1223A and the receiving case 1221A, the pressure of the suction end of the vacuum pump 1211A can decrease rapidly. When the pressure of the suction end of the vacuum pump 1211A sensed by the pressure sensor 1214A reaches a predetermined low pressure, the controller 1212A can stop the vacuum pump 1211A for preventing the vacuum device 121A from overloading. However, the present invention is not limited to this embodiment. For example, in another embodiment, the pressure sensor can be omitted.

Figure 11:
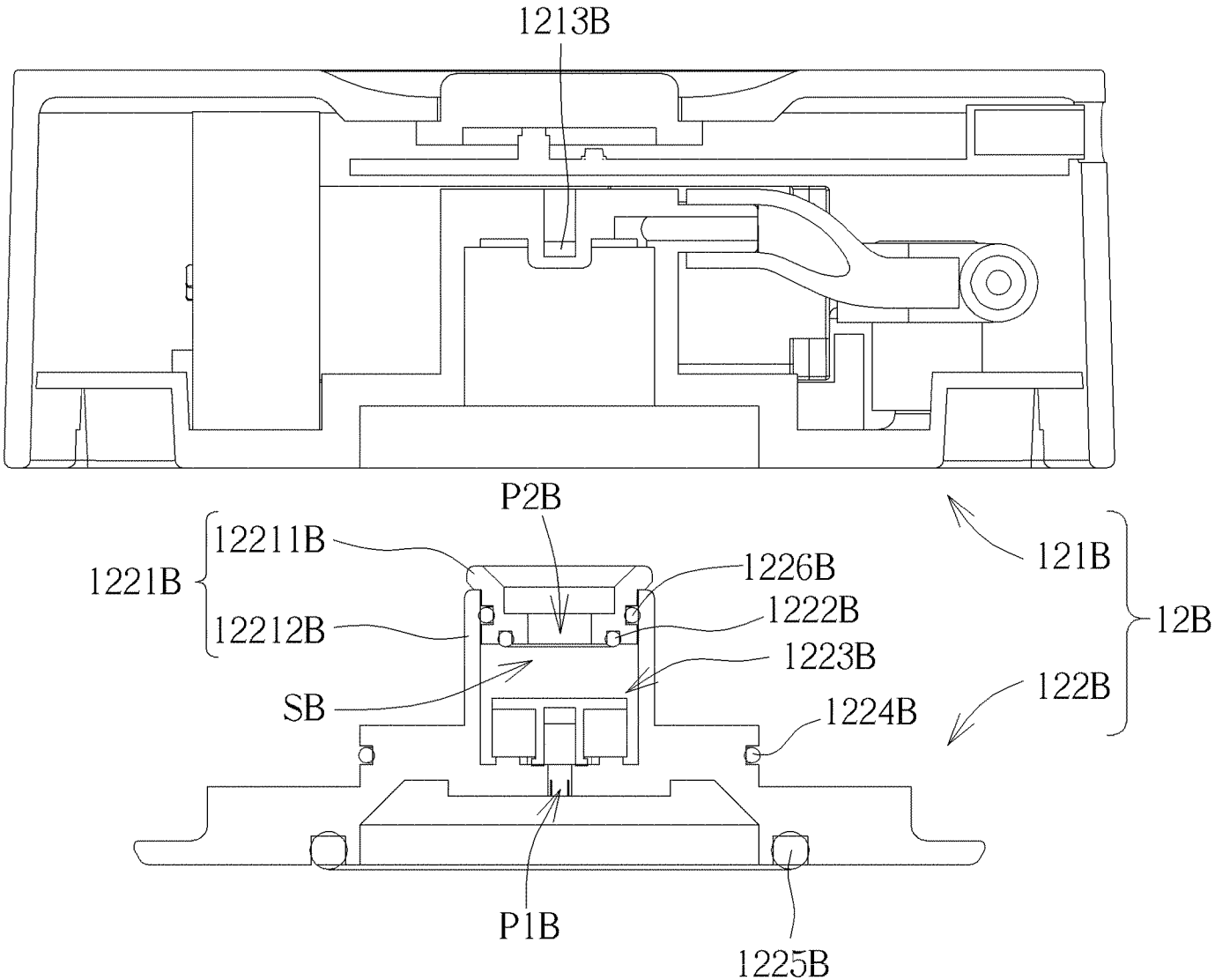
FIG. 11 is an internal structural diagram of a vacuum kit according to a second embodiment of the present invention.
Figure 12:
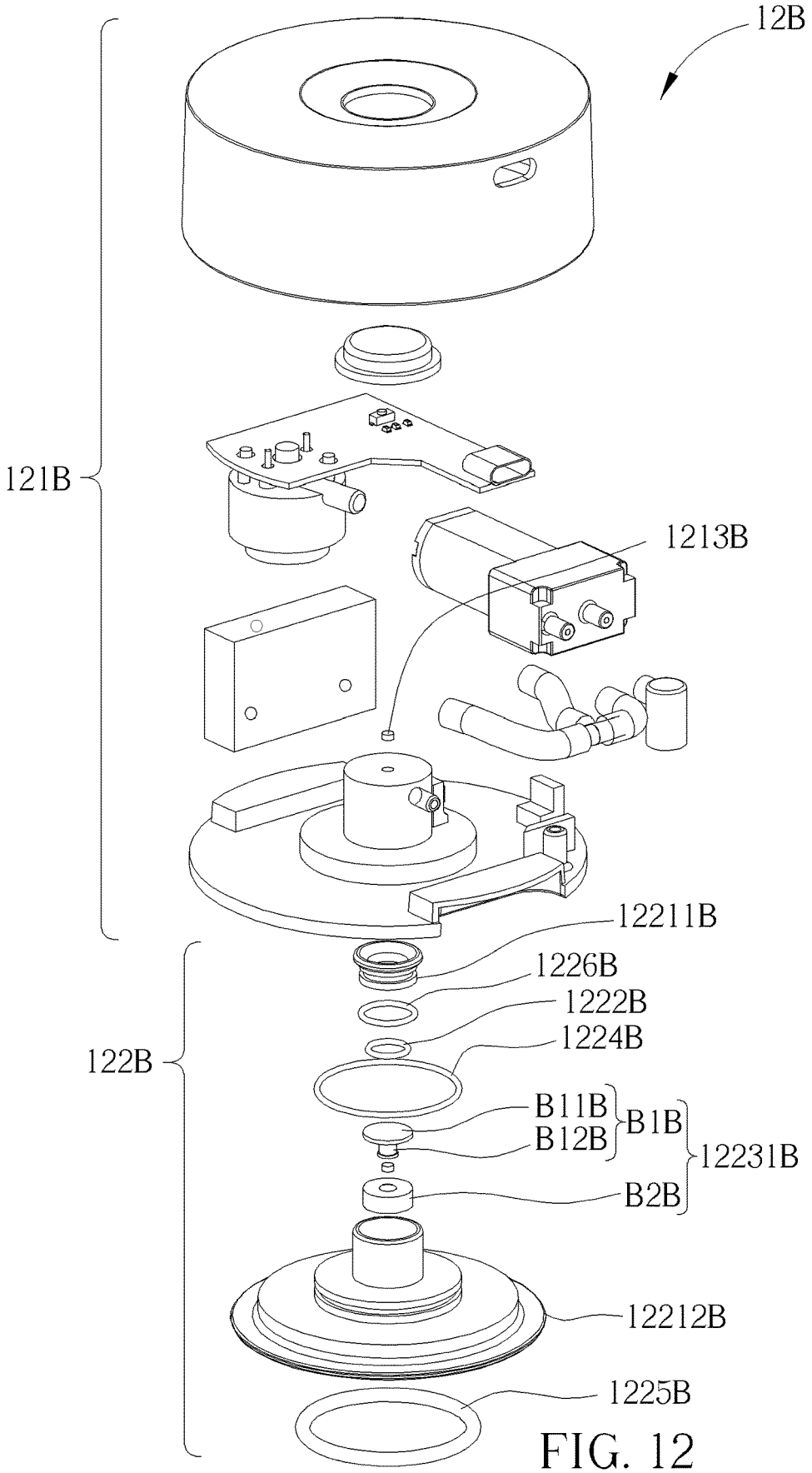
FIG. 12 is an exploded diagram of the vacuum kit according to the second embodiment of the present invention.
Figure 13:
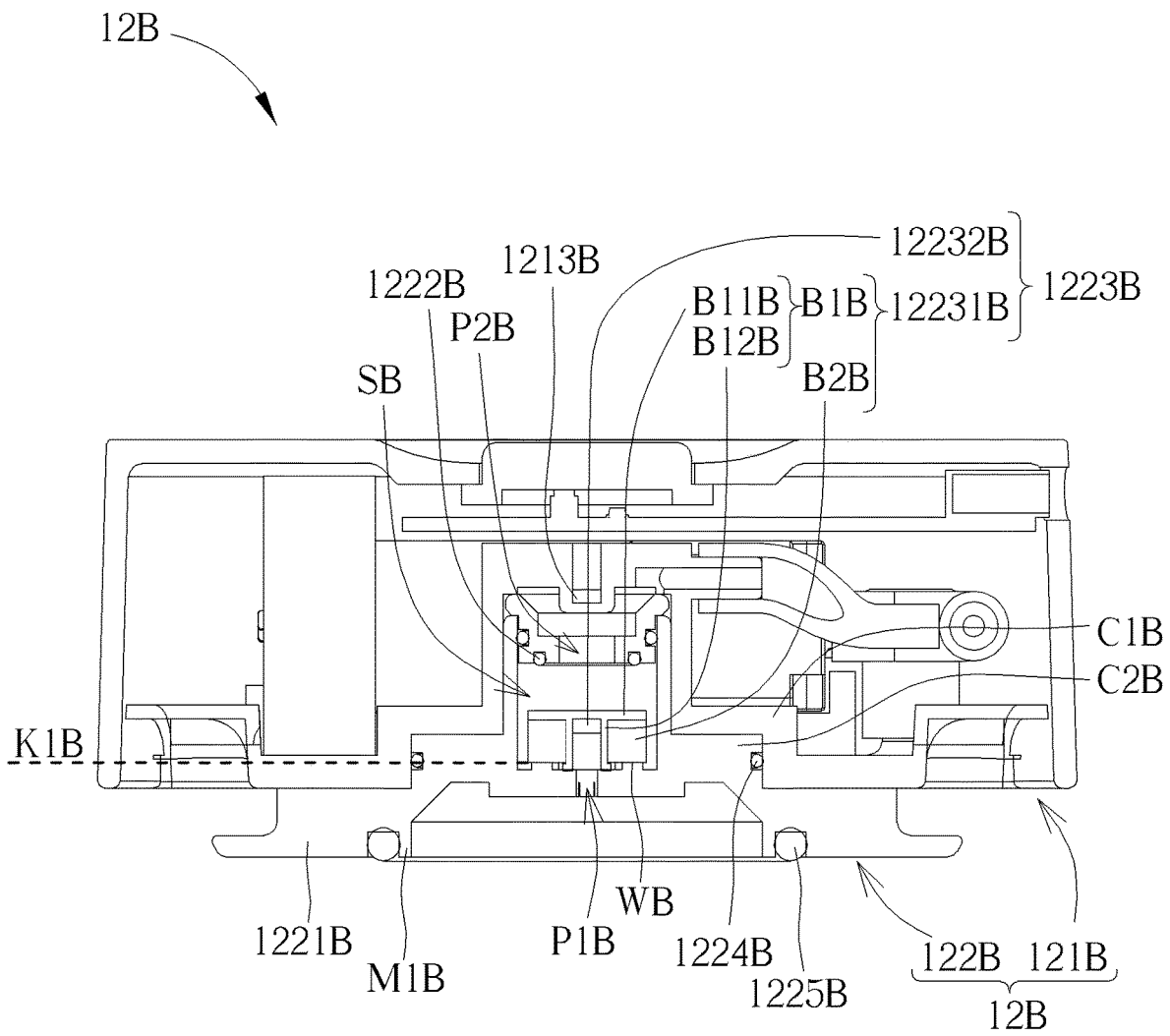
FIG. 13 is a diagram of the vacuum kit as a buoyant device is located at an initial position according to the second embodiment of the present invention.
Figure 14:
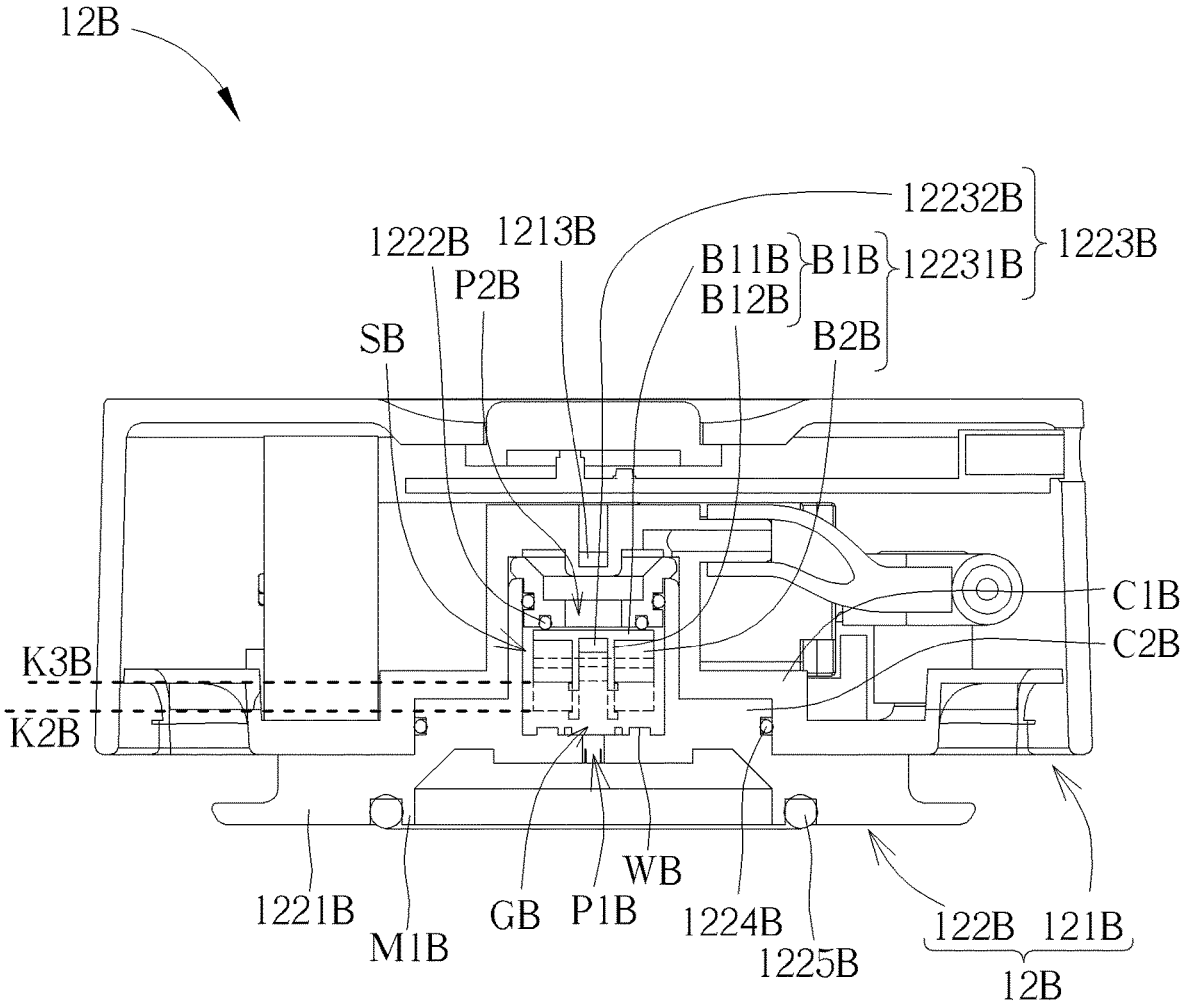
FIG. 14 is a diagram of the vacuum kit as the buoyant device is located at a clamping position according to the second embodiment of the present invention.

Please refer to FIG. 11 to FIG. 14. FIG. 11 is an internal structural diagram of a vacuum kit 12B according to a second embodiment of the present invention. FIG. 12 is an exploded diagram of the vacuum kit 12B according to the second embodiment of the present invention. FIG. 13 is a diagram of the vacuum kit 12B as a buoyant device 1223B is located at an initial position K1B according to the second embodiment of the present invention. FIG. 14 is a diagram of the vacuum kit 12B as the buoyant device 1223B is located at a clamping position K3B according to the second embodiment of the present invention. As shown in FIG. 11 to FIG. 14, the vacuum kit 12B can be adapted for a container which is similar to the container 11A of the first embodiment. The vacuum kit 12B includes a vacuum device 121B and a liquid receiver 122B detachably assembled with the vacuum device 121B. The liquid receiver 122B includes a receiving case 1221B, a sealing component 1222B and the buoyant device 1223B. The receiving case 1221B includes an upper case portion 12211B and a lower case portion 12212B detachably assembled with the upper case portion 12211B. A first cooperating structure C1B is formed on the vacuum device 121B, and a second cooperating structure C2B is formed on the upper case portion 12211B of the receiving case 1221B configured to cooperate with the first cooperating structure C1B for facilitating assembly of the vacuum device 121B and the liquid receiver 122B. The first cooperating structure C1B and the second cooperating structure C2B can be a cooperating recessed structure and a cooperating protruding structure, respectively. A first mating structure M1B is formed on the lower case portion 12212B of the receiving case 1221B and configured to cooperate with a second mating structure formed on a valve seat of the container for aligning the receiving case 1221B with the valve seat of the container. An inlet P1B of the receiving case 1221B is formed on the lower case portion 12212B of the receiving case 1221B, and an outlet P2B of the receiving case 1221B is formed on the upper case portion 12211B of the receiving case 1221B. The sealing component 1222B is disposed on a wall of the upper case portion 12211B of the receiving case 1221B and located adjacent to the outlet P2B of the receiving case 1221B. The buoyant device 1223B is movable relative to the receiving case 1221B between the initial position K1B as shown in FIG. 13 and the clamping position K3B as shown in FIG. 14 through an actuating position K2B as shown in FIG. 14. When the buoyant device 1223B is located at the clamping position K3B as shown in FIG. 14, the sealing component 1222B is clamped by the buoyant device 1223B and the receiving case 1221B for sealing the outlet P2B of the receiving case 1221B.

The buoyant device 1223B includes a buoyant assembly 12231B and a magnetic component 12232B. The buoyant assembly 12231B is movably received in a receiving space SB of the receiving case 1221B defined by the upper case portion 12211B and the lower case portion 12212B of the receiving case 1221B. The buoyant assembly 12231B includes a first buoyant component B1B and a second buoyant component B2B detachably assembled with the first buoyant component B1B. The second buoyant component B2B is formed in a circular disc shape, and the first buoyant component B1B includes a main body portion B11B and an extending portion B12B. The main body portion B11B of the first buoyant component B1B is located at a side of the second buoyant component B2B away from the inlet P1B of the receiving case 1221B and for abutting against the sealing component 1222B. The extending portion B12B of the first buoyant component B1B extends from the main body portion B11B of the first buoyant component B1B toward the inlet P1B of the receiving case 1221B and passes through the second buoyant component B2B. The magnetic component 12232B is engaged with the first buoyant component B1B and at least partially disposed inside a proximal end of the extending portion B12B of the first buoyant component B1B adjacent to the main body portion B11B of the first buoyant component B1B and for cooperating with a magnetically attractive component 1213B on the vacuum device 121B. A guiding structure GB is formed on the lower case portion 12212B of the receiving case 1221B and configured to cooperate with the extending portion B12B for guiding the buoyant device 1223B to move back to the initial position K1B. The guiding structure GB can be defined by a plurality of erecting walls WB on the lower case portion 12212B.

The liquid receiver 122B further includes a first auxiliary sealing component 1224B, a second auxiliary sealing component 1225B and a third auxiliary sealing component 1226B. The first auxiliary sealing component 1224B is disposed on the receiving case 1221B and configured to be engaged between the vacuum device 121B and the receiving case 1221B for preventing any leakage through a gap between the vacuum device 121B and the receiving case 1221B. The second auxiliary sealing component 1225B is disposed on the receiving case 1221B and configured to be engaged between the receiving case 1221B and the valve seat of the container for preventing any leakage through a gap between the receiving case 1221B and the valve seat of the container. The third auxiliary sealing component 1226B is disposed on the upper case portion 12211B and configured to be engaged between the upper case portion 12211B and the lower case portion 12212B of the receiving case 1221B of the container for preventing any leakage through a gap between the upper case portion 12211B and the lower case portion 12212B of the receiving case 1221B. Comparing with the liquid receiver 122A of the first embodiment, the liquid receiver 122B of this embodiment can further ensure that no liquid flows through the outlet P2B of the receiving case 1221B before the outlet P2B of the receiving case 1221B is sealed, and therefore, the liquid receiver 122B of this embodiment can more effectively prevent a liquid damage of the vacuum device 121B even when the vacuum kit 12B is upside down or titled.

Other details of this embodiment are the same as the ones of the first embodiment in essence, and can have variations similar to the ones mentioned previously except for some minor changes, e.g. sizes and/or arrangements of the components. Detailed description is omitted herein for simplicity.

Figure 15:
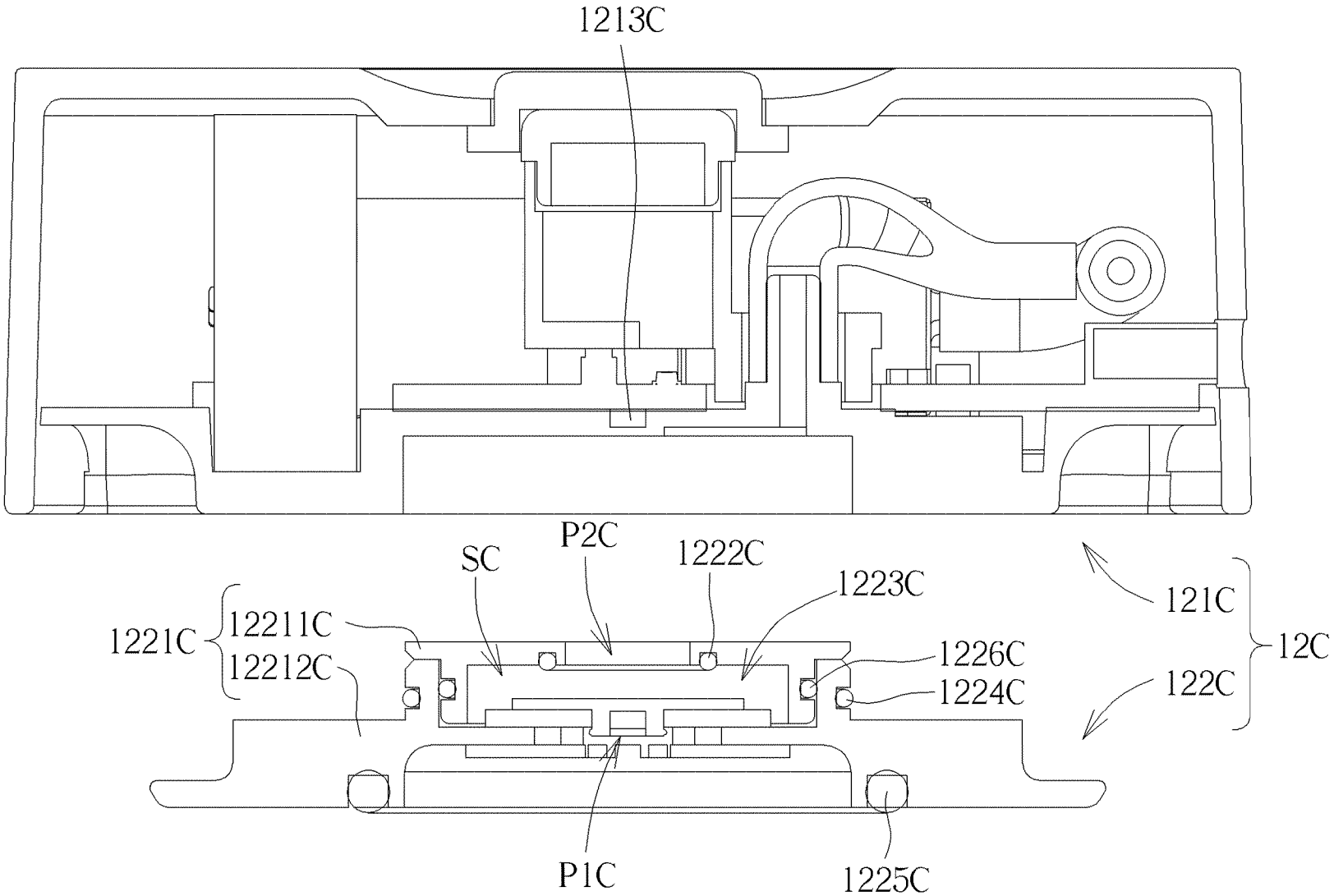
FIG. 15 is an internal structural diagram of a vacuum kit according to a third embodiment of the present invention.
Figure 16:
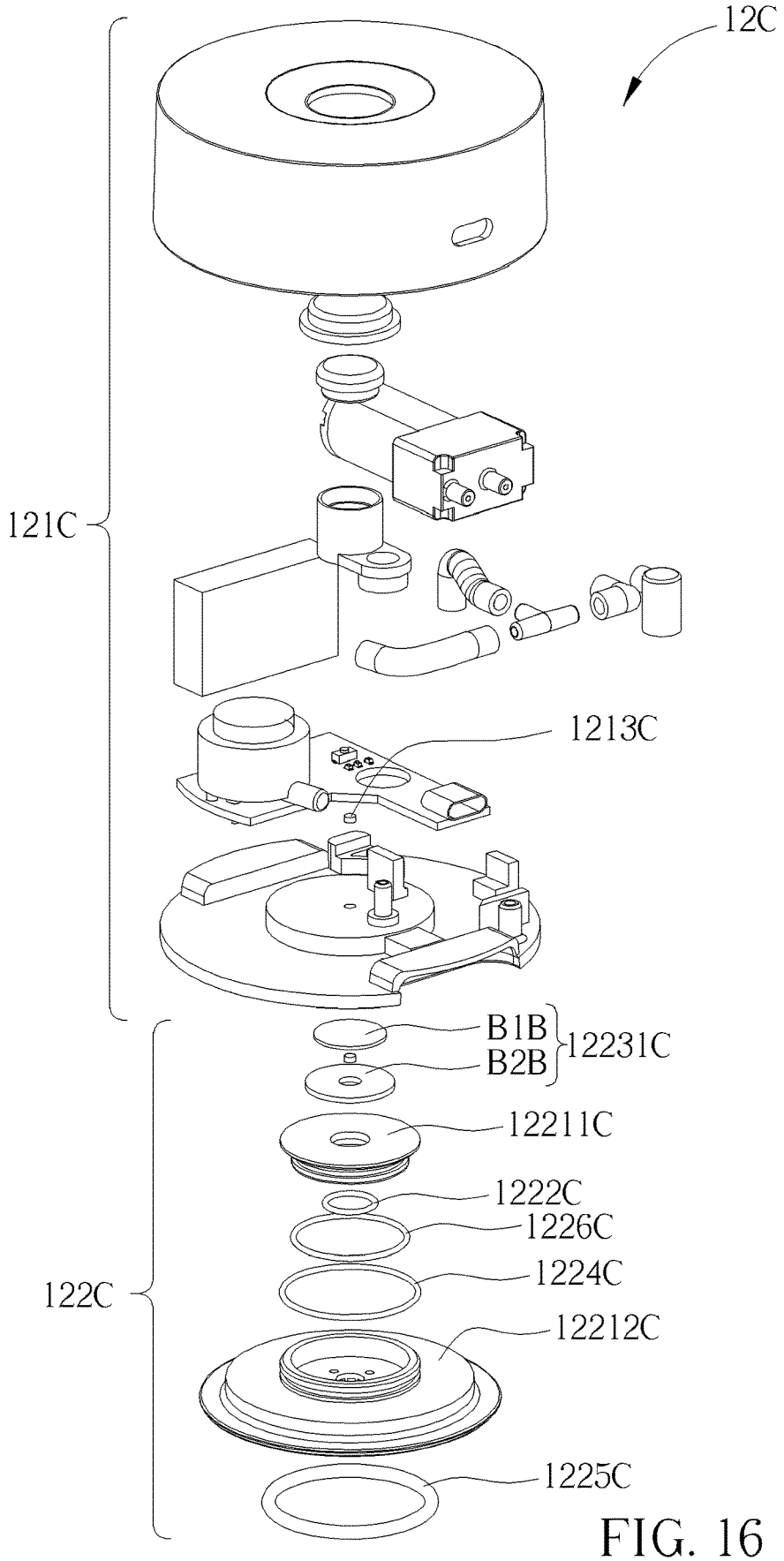
FIG. 16 is an exploded diagram of the vacuum kit according to the third embodiment of the present invention.
Figure 17:
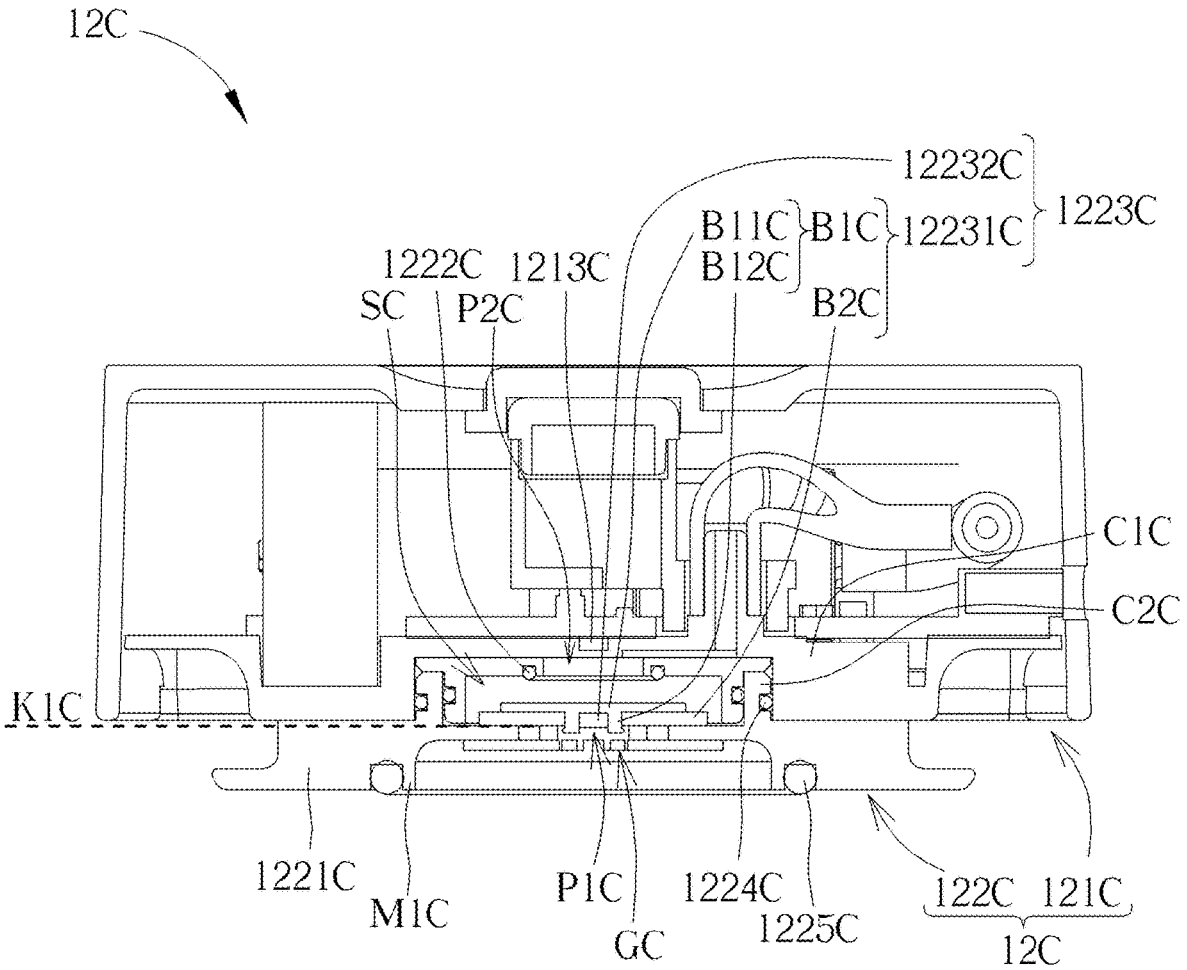
FIG. 17 is a diagram of the vacuum kit as a buoyant device is located at an initial position according to the third embodiment of the present invention.
Figure 18:
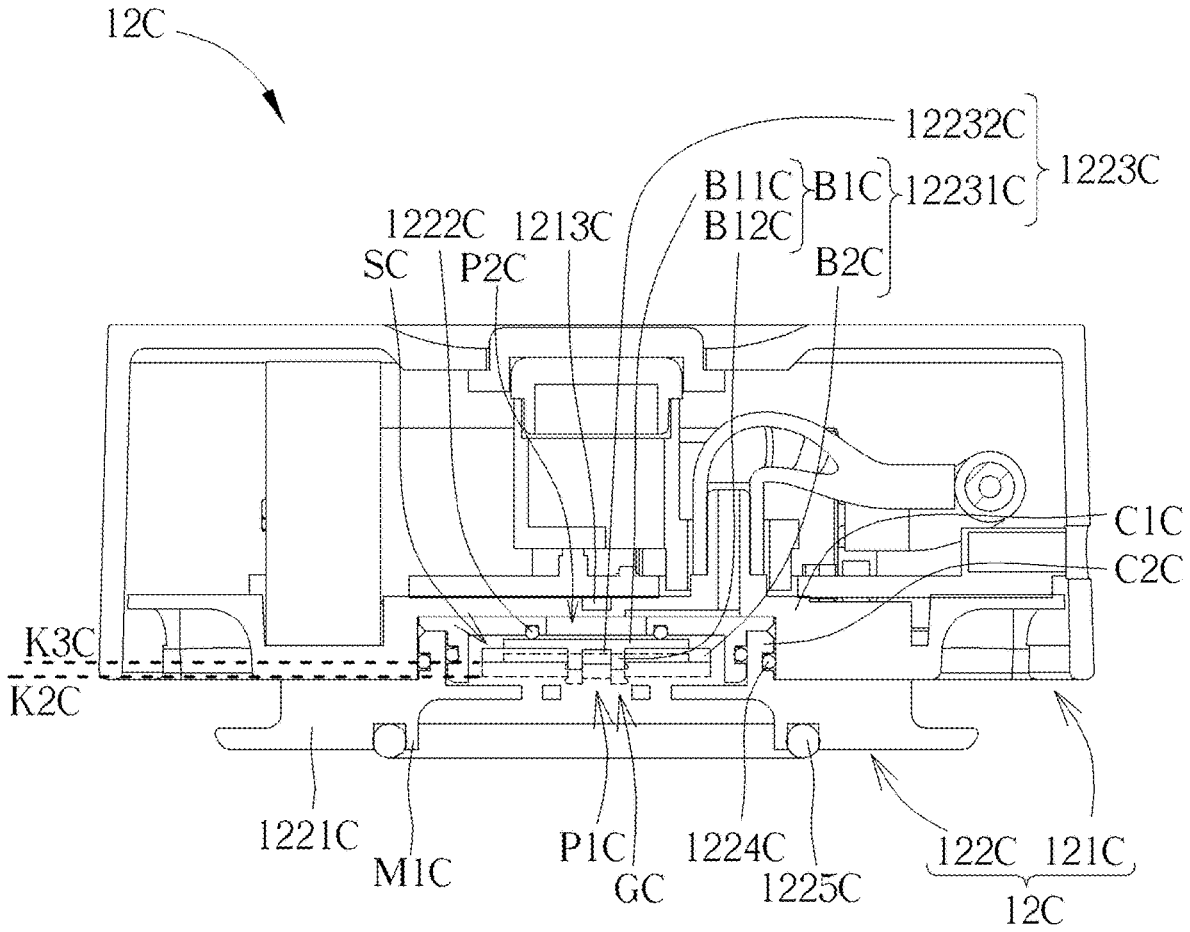
FIG. 18 is a diagram of the vacuum kit as the buoyant device is located at a clamping position according to the third embodiment of the present invention.

Please refer to FIG. 15 to FIG. 18. FIG. 15 is an internal structural diagram of a vacuum kit 12C according to a third embodiment of the present invention. FIG. 16 is an exploded diagram of the vacuum kit 12C according to the third embodiment of the present invention. FIG. 17 is a diagram of the vacuum kit 12C as a buoyant device 1223C is located at an initial position K1C according to the third embodiment of the present invention. FIG. 18 is a diagram of the vacuum kit 12C as the buoyant device 1223C is located at a clamping position K3C according to the third embodiment of the present invention. As shown in FIG. 15 to FIG. 18, the vacuum kit 12C can be adapted for a container which is similar to the container 11A of the first embodiment. The vacuum kit 12C includes a vacuum device 121C and a liquid receiver 122C detachably assembled with the vacuum device 121C. The liquid receiver 122C includes a receiving case 1221C, a sealing component 1222C and the buoyant device 1223C. The receiving case 1221C includes an upper case portion 12211C and a lower case portion 12212C detachably assembled with the upper case portion 12211C. A first cooperating structure C1C is formed on the vacuum device 121C, and a second cooperating structure C2C is formed on the upper case portion 12211C of the receiving case 1221C and configured to cooperate with the first cooperating structure C1C for facilitating assembly of the vacuum device 121C and the liquid receiver 122C. The first cooperating structure C1C and the second cooperating structure C2C can be a cooperating recessed structure and a cooperating protruding structure, respectively. A first mating structure MIC is formed on the lower case portion 12212C of the receiving case 1221C and configured to cooperate with a second mating structure formed on a valve seat of the container for aligning the receiving case 1221C with the valve seat of the container. An inlet PIC of the receiving case 1221C is formed on the lower case portion 12212C of the receiving case 1221C, and an outlet P2C of the receiving case 1221C is formed on the upper case portion 12211C of the receiving case 1221C. The sealing component 1222C is disposed on a wall of the upper case portion 12211C of the receiving case 1221C and located adjacent to the outlet P2C of the receiving case 1221C. The buoyant device 1223C is movable relative to the receiving case 1221C between the initial position K1C as shown in FIG. 17 and the clamping position K3C as shown in FIG. 18 through an actuating position K2C as shown in FIG. 18. When the buoyant device 1223C is located at the clamping position K3C as shown in FIG. 18, the sealing component 1222C is clamped by the buoyant device 1223C and the receiving case 1221C for sealing the outlet P2C of the receiving case 1221C.

The buoyant device 1223C includes a buoyant assembly 12231C and a magnetic component 12232C. The buoyant assembly 12231C is movably received in a receiving space SC of the receiving case 1221C defined by the upper case portion 12211C and the lower case portion 12212C of the receiving case 1221C. The buoyant assembly 12231C includes a first buoyant component B1C and a second buoyant component B2C detachably assembled with the first buoyant component B1C. The second buoyant component B2C is formed in a circular disc shape, and the first buoyant component BIC includes a main body portion B11C and an extending portion B12C. The main body portion B11C of the first buoyant component B1C is located at a side of the second buoyant component B2C away from the inlet PIC of the receiving case 1221C and for abutting against the sealing component 1222C. The extending portion B12C of the first buoyant component B1C extends from the main body portion B11C of the first buoyant component BIC toward the inlet PIC of the receiving case 1221C and passes through the second buoyant component B2C. The magnetic component 12232C is engaged with the first buoyant component B1C and at least partially disposed inside a proximal end of the extending portion B12C of the first buoyant component BIC adjacent to the main body portion B11C of the first buoyant component B1C for cooperating with a magnetically attractive component 1213C on the vacuum device 121C. A guiding structure GC is formed on the lower case portion 12212C of the receiving case 1221C and configured to cooperate with the extending portion B12C for guiding the buoyant device 1223C to move back to the initial position K1C. The guiding structure GC can be defined by a through hole on the lower case portion 12212C. The liquid receiver 122C further includes a first auxiliary sealing component 1224C, a second auxiliary sealing component 1225C and a third auxiliary sealing component 1226C. The first auxiliary sealing component 1224C is disposed on the receiving case 1221C and configured to be engaged between the vacuum device 121C and the receiving case 1221C for preventing any leakage through a gap between the vacuum device 121C and the receiving case 1221C. The second auxiliary sealing component 1225C is disposed on the receiving case 1221C and configured to be engaged between the receiving case 1221C and the valve seat of the container for preventing any leakage through a gap between the receiving case 1221C and the valve seat of the container. The third auxiliary sealing component 1226C is disposed on the upper case portion 12211C and configured to be engaged between the upper case portion 12211C and the lower case portion 12212C of the receiving case 1221C of the container for preventing any leakage through a gap between the upper case portion 12211C and the lower case portion 12212C of the receiving case 1221C. Comparing with the liquid receiver 122A of the first embodiment, the liquid receiver 122C of this embodiment can also ensure that no liquid flows through the outlet P2C of the receiving case 1221C before the outlet P2C of the receiving case 1221C is sealed, and therefore, the liquid receiver 122C of this embodiment can more effectively prevent a liquid damage of the vacuum device 121C even when vacuum kit 12C is upside down or titled.

Other details of this embodiment are the same as the ones of the first embodiment in essence, and can have variations similar to the ones mentioned previously except for some minor changes, e.g. sizes and/or arrangements of the components. Detailed description is omitted herein for simplicity.

Figure 19:
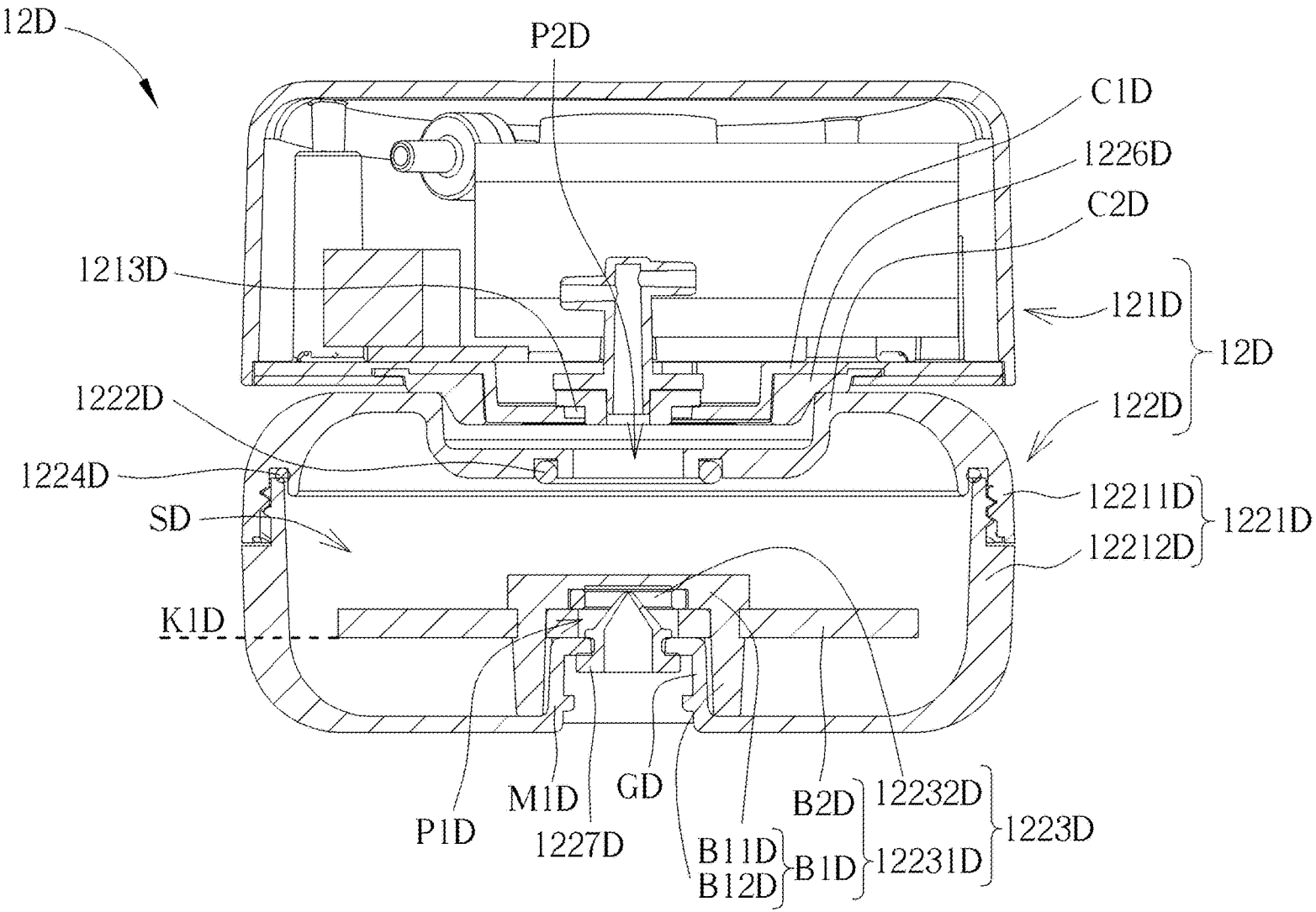
FIG. 19 is a diagram of a vacuum kit as a buoyant device is located at an initial position according to a fourth embodiment of the present invention.
Figure 20:
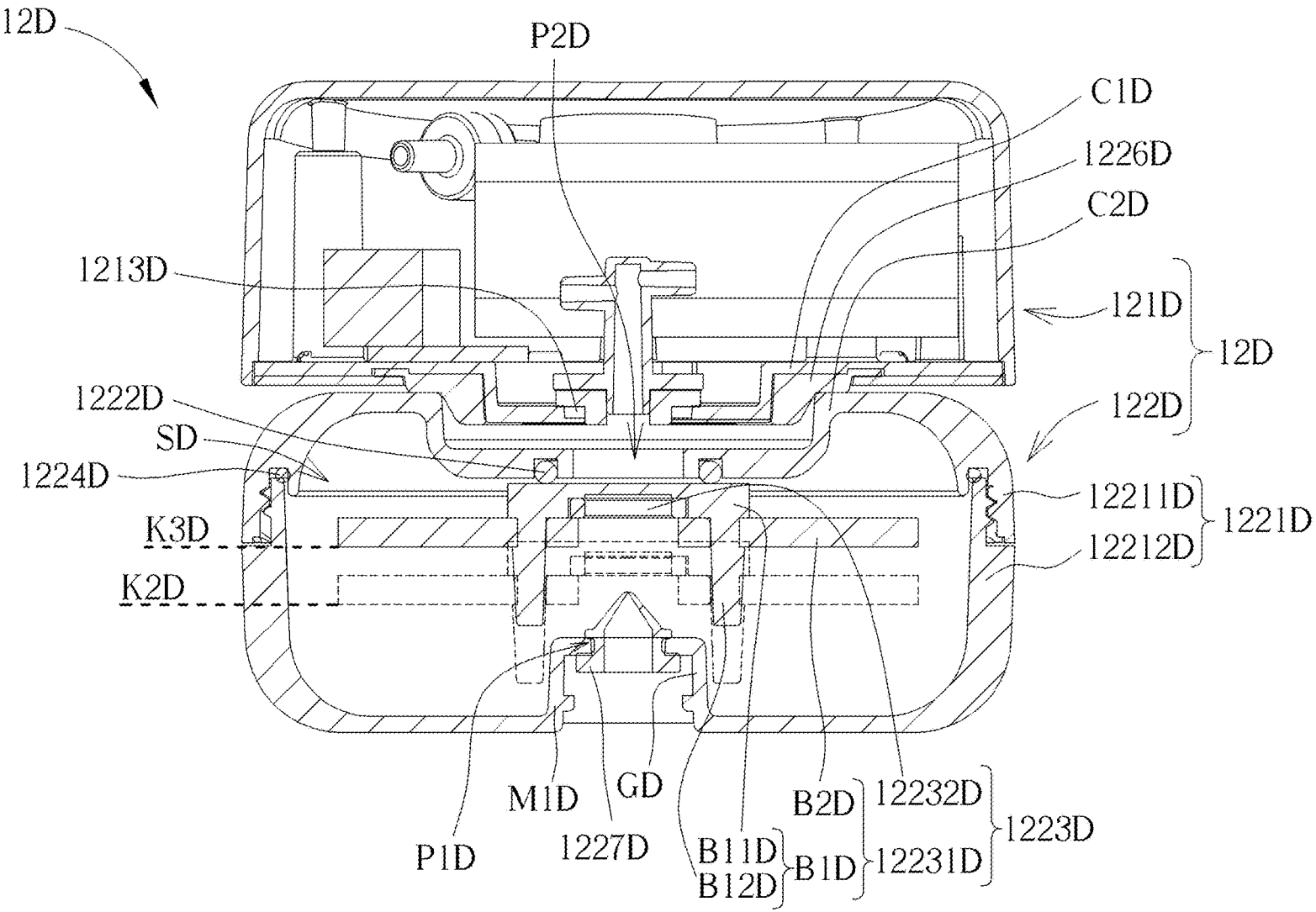
FIG. 20 is a diagram of the vacuum kit as the buoyant device is located at a clamping position according to the fourth embodiment of the present invention.
Figure 21:
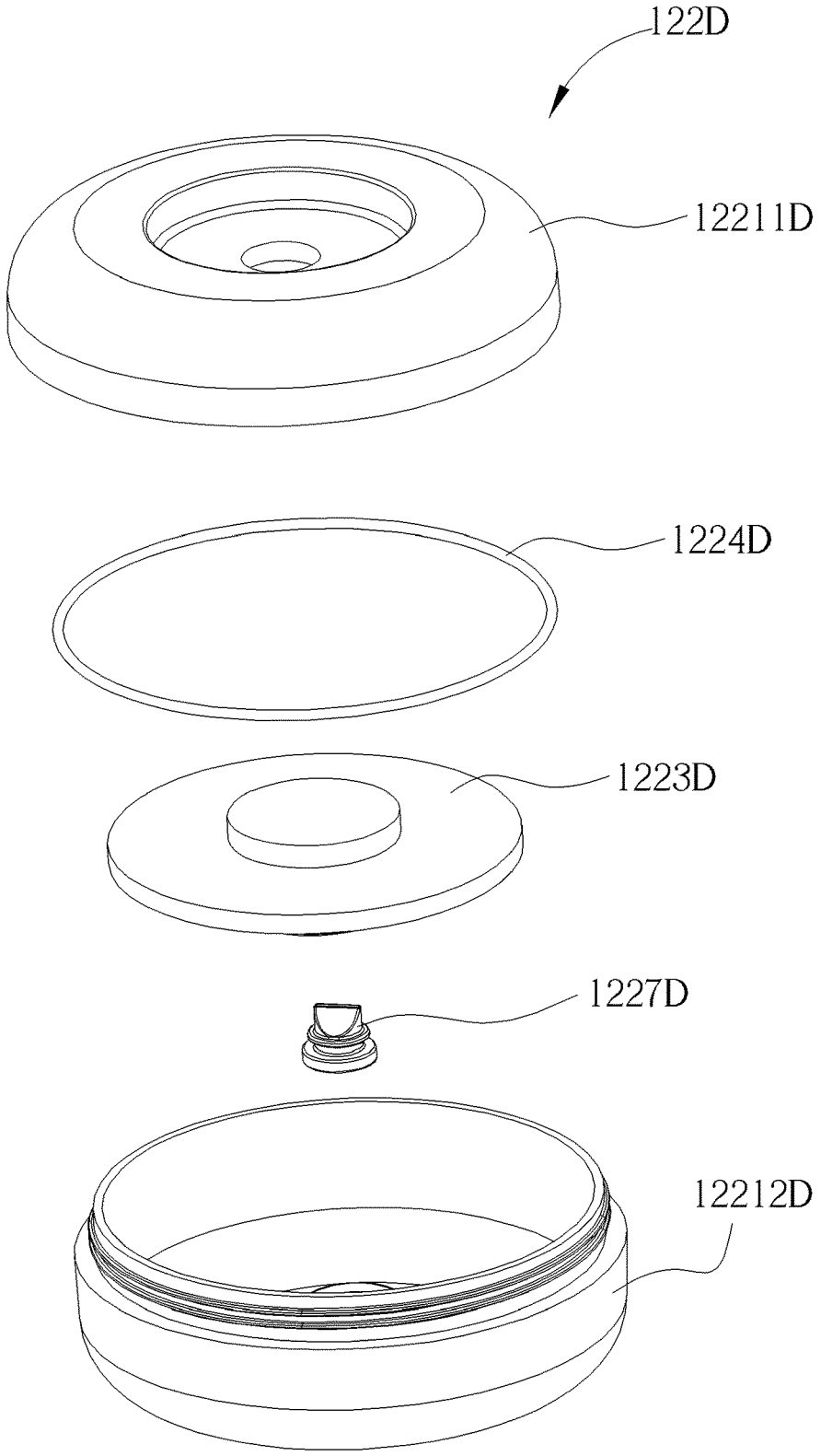
FIG. 21 is an exploded diagram of a liquid receiver according to the fourth embodiment of the present invention.
Figure 22:
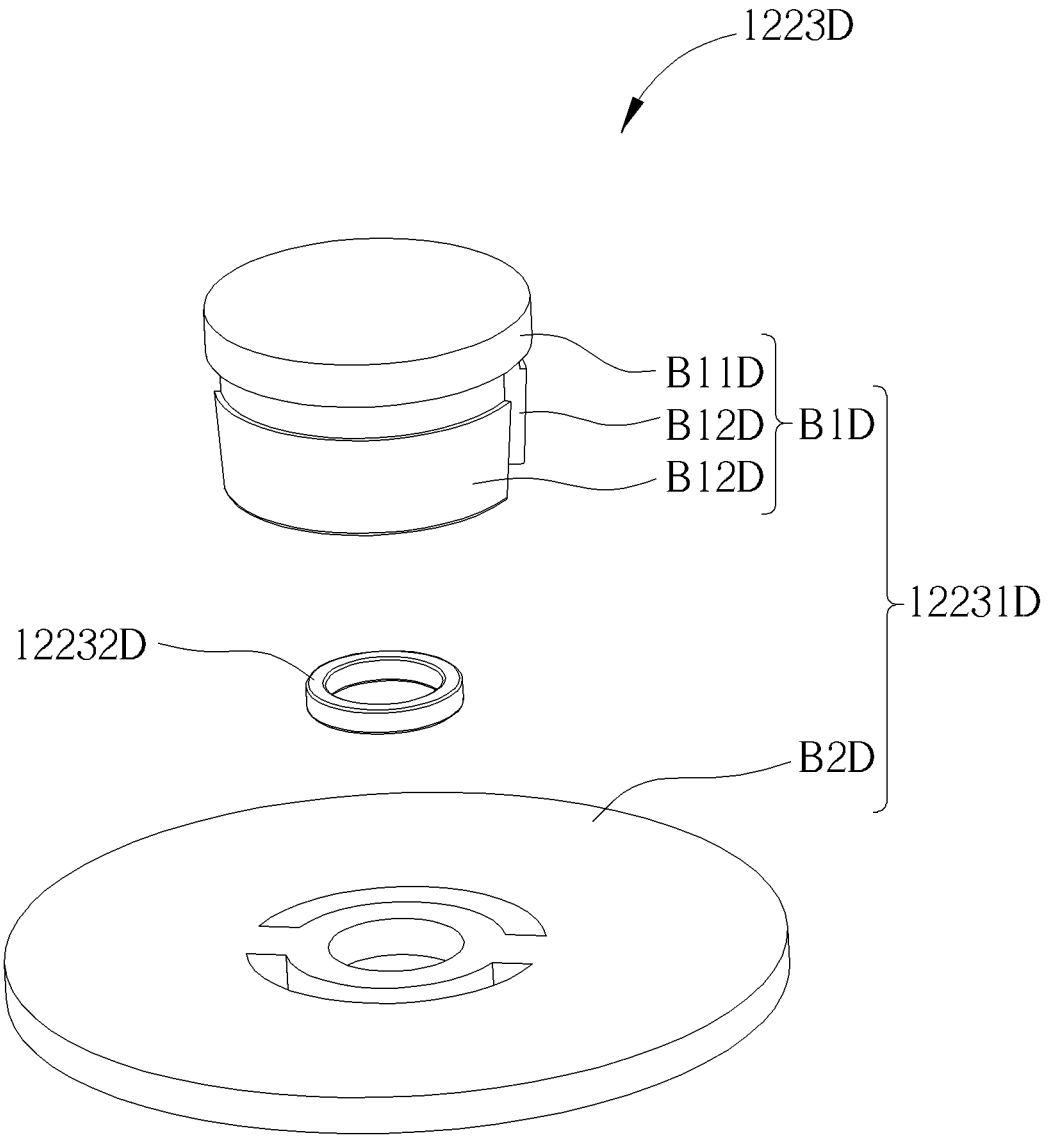
FIG. 22 is an exploded diagram of the buoyant device according to the fourth embodiment of the present invention.

Please refer to FIG. 19 to FIG. 22. FIG. 19 is a diagram of a vacuum kit 12D as a buoyant device 1223D is located at an initial position K1D according to a fourth embodiment of the present invention. FIG. 20 is a diagram of the vacuum kit 12D as the buoyant device 1223D is located at a clamping position K3D according to the fourth embodiment of the present invention. FIG. 21 is an exploded diagram of a liquid receiver 122D according to the fourth embodiment of the present invention. FIG. 22 is an exploded diagram of the buoyant device 1223D according to the fourth embodiment of the present invention. As shown in FIG. 19 to FIG. 22, the vacuum kit 12D can be adapted for a container which is similar to the container 11A of the first embodiment. The vacuum kit 12D includes a vacuum device 121D and the liquid receiver 122D detachably assembled with the vacuum device 121D. The liquid receiver 122D includes a receiving case 1221D, a sealing component 1222D and the buoyant device 1223D. The receiving case 1221D is formed in a cup shape and includes an upper case portion 12211D and a lower case portion 12212D detachably assembled with the upper case portion 12211D. A first cooperating structure C1D is formed on the vacuum device 121D, and a second cooperating structure C2D is formed on the upper case portion 12211D of the receiving case 1221D and configured to cooperate with the first cooperating structure C1D for facilitating assembly of the vacuum device 121D and the liquid receiver 122D. The first cooperating structure C1D and the second cooperating structure C2D can be a cooperating protruding structure and a cooperating recessed structure, respectively. A first mating structure M1D is formed on the lower case portion 12212D of the receiving case 1221D and configured to cooperate with a second mating structure formed on a valve seat of the container for aligning the receiving case 1221D with the valve seat of the container. An inlet P1D of the receiving case 1221D is formed on the lower case portion 12212D of the receiving case 1221D, and an outlet P2D of the receiving case 1221D is formed on the upper case portion 12211D of the receiving case 1221D. The sealing component 1222D is disposed on a wall of the upper case portion 12211D of the receiving case 1221D and located adjacent to the outlet P2D of the receiving case 1221D. The buoyant device 1223D is movable relative to the receiving case 1221D between the initial position K1D as shown in FIG. 19 and the clamping position K3D as shown in FIG. 20 through an actuating position K2D as shown in FIG. 20. When the buoyant device 1223D is located at the clamping position K3D as shown in FIG. 20, the sealing component 1222D is clamped by the buoyant device 1223D and the receiving case 1221D for sealing the outlet P2D of the receiving case 1221D.

The buoyant device 1223D includes a buoyant assembly 12231D and a magnetic component 12232D. The buoyant assembly 12231D is movably received in a receiving space SD of the receiving case 1221D defined by the upper case portion 12211D and the lower case portion 12212D of the receiving case 1221D. The buoyant assembly 12231D includes a first buoyant component B1D and a second buoyant component B2D detachably assembled with the first buoyant component B1D. The second buoyant component B2D is formed in a circular disc shape, and the first buoyant component B1D includes a main body portion B11D and two extending portions B12D. The main body portion B11D of the first buoyant component B1D is located at a side of the second buoyant component B2D away from the inlet P1D of the receiving case 1221D and for abutting against the sealing component 1222D. The two extending portions B12D of the first buoyant component B1D extend from the main body portion B11D of the first buoyant component B1D toward the inlet P1D of the receiving case 1221D and pass through the second buoyant component B2D. The magnetic component 12232D is engaged with and located between the main body portion B11D of the first buoyant component B1D and the second buoyant component B2D for cooperating with a magnetically attractive component 1213D on the vacuum device 121D. A guiding structure GD is formed on the lower case portion 12212D of the receiving case 1221D and configured to cooperate with the extending portion B12D for guiding the buoyant assembly 12231D to move back to the initial position K1D. The guiding structure GD can be defined by an inward protruding portion of the inlet P1D of the receiving case 1221D.

The liquid receiver 122D further includes a first auxiliary sealing component 1224D, a third auxiliary sealing component 1226D and a non-return valve 1227D. The first auxiliary sealing component 1224D is disposed on the vacuum device 121D and configured to be engaged between the vacuum device 121D and the receiving case 1221D for preventing any leakage through a gap between the vacuum device 121D and the receiving case 1221D. The third auxiliary sealing component 1226D is disposed on the upper case portion 12211D and configured to be engaged between the upper case portion 12211D and the lower case portion 12212D of the receiving case 1221D of the container for preventing any leakage through a gap between the upper case portion 12211D and the lower case portion 12212D of the receiving case 1221D. The non-return valve 1227D is disposed on the inlet P1D of the receiving case 1221D for preventing any leakage through the inlet P1D of the receiving case 1221D when the liquid receiver 122D is detached from the container. Comparing with the liquid receiver 122A of the first embodiment, the liquid receiver 122D of this embodiment can ensure that no liquid flows through the outlet P2D of the receiving case 1221D before the outlet P2D of the receiving case 1221D is sealed, and therefore, the liquid receiver 122D of this embodiment can more effectively prevent a liquid damage of the vacuum device 121D even when the vacuum kit 12D is upside down or titled. Besides, the liquid receiver 122D of this embodiment can also ensure that no liquid flows through the inlet P1D of the receiving case 1221D when the liquid receiver 122D is detached from the container.

Other details of this embodiment are the same as the ones of the first embodiment in essence, and can have variations similar to the ones mentioned previously except for some minor changes, e.g. sizes and/or arrangements of the components. Detailed description is omitted herein for simplicity.

In contrast to the prior art, the liquid receiver of the present invention is configured to clamp the sealing component by the buoyant device and the receiving case for sealing the outlet of the receiving case, so as to prevent liquid flowing out of the container from entering into the vacuum device. Therefore, the present invention can effectively prevent a liquid damage of the vacuum device.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A vacuum kit adapted for a container, the vacuum kit comprising:
- a vacuum device; and
- a liquid receiver detachably assembled with the vacuum device, the liquid receiver comprising:
  - a receiving case comprising an inlet and an outlet;
  - a sealing component disposed adjacent to the outlet of the receiving case; and
  - a buoyant device movable between an initial position and a clamping position relative to the receiving case, the buoyant device comprising:
    - a buoyant assembly at least partially movably received in the receiving case; and
    - a magnetic component engaged with the buoyant assembly, the magnetic component being configured to provide a magnetic force when the vacuum device and the liquid receiver are assembled with each other;
- wherein when the buoyant device is located at the initial position, the magnetic force does not drive the buoyant device to move away from the initial position;
- wherein after the buoyant device is driven by the liquid flowing out of the container to move from the initial position to an actuating position between the initial position and the clamping position, the magnetic force drives the buoyant device to move from the actuating position to the clamping position to clamp the sealing component by the buoyant device and the receiving case for sealing the outlet of the receiving case.

2. The vacuum kit of claim 1, wherein the receiving case further comprises an upper case portion and a lower case portion detachably assembled with the upper case portion, the inlet is formed on the lower case portion, and the outlet is formed on the upper case portion.

3. The vacuum kit of claim 2, wherein the liquid receiver further comprises at least one auxiliary sealing component configured to be engaged between the upper case portion and the lower case portion, between the vacuum device and the receiving case and/or between the receiving case and the container.

4. The vacuum kit of claim 1, wherein a first cooperating structure is formed on the vacuum device, and a second cooperating structure is formed on the receiving case for cooperating with the first cooperating structure for facilitating assembly of the vacuum device and the liquid receiver.

5. The vacuum kit of claim 1, wherein the buoyant assembly comprises a first buoyant component and a second buoyant component detachably assembled with the first buoyant component, the second buoyant component is formed in a circular disc shape, and the first buoyant component comprises a main body portion and at least one extending portion extending from the main body portion and passing through the second buoyant component.

6. The vacuum kit of claim 5, wherein the magnetic component is disposed between the first buoyant component and the second buoyant component or at least partially disposed inside the first buoyant component.

7. The vacuum kit of claim 5, wherein a guiding structure is formed on the receiving case and configured to cooperate with the at least one extending portion for guiding the buoyant assembly.

8. The vacuum kit of claim 1, wherein the vacuum device comprises:

a vacuum pump;

a controller electrically connected to the vacuum pump; and a pressure sensor electrically connected to the controller and for actuating the controller to control the vacuum pump according to a sensing result of the pressure sensor.

9. The vacuum kit of claim 1, wherein the liquid receiver further comprises at least one auxiliary sealing component configured to be engaged between the vacuum device and the receiving case and/or between the receiving case and the container.

10. A vacuum product comprising:

a container comprising:

a containing body;

a valve seat disposed on the containing body; and a one-way valve disposed on the valve seat; and a vacuum kit comprising:

a vacuum device; and a liquid receiver detachably assembled with the vacuum device, the liquid receiver comprising:

a receiving case configured to be detachably engaged with the valve seat and comprising an inlet and an outlet;

a sealing component disposed adjacent to the outlet of the receiving case; and a buoyant device movable between an initial position and a clamping position relative to the receiving case, the buoyant device comprising:

a buoyant assembly at least partially movably received in the receiving case; and a magnetic component engaged with the buoyant assembly, the magnetic component being configured to provide a magnetic force when the vacuum device and the liquid receiver are assembled with each other;

wherein when the buoyant device is located at the initial position, the magnetic force does not drive the buoyant device to move away from the initial position;

wherein after the buoyant device is driven by the liquid flowing out of the container to move from the initial position to an actuating position between the initial position and the clamping position, the magnetic force drives the buoyant device to move from the actuating position to the clamping position to clamp the sealing component by the buoyant device and the receiving case for sealing the outlet of the receiving case.

11. The vacuum product of claim 10, wherein a first mating structure is formed on the receiving case, and a second mating structure is formed on the valve seat and configured to cooperate with the first mating structure for aligning the receiving case with the valve seat.

12. The vacuum product of claim 10, wherein the container further comprises a filtering component disposed on the valve seat and configured to filter particles.

13. The vacuum product of claim 10, wherein the receiving case further comprises an upper case portion and a lower case portion detachably assembled with the upper case portion, the inlet is formed on the lower case portion, and the outlet is formed on the upper case portion.

14. The vacuum product of claim 13, wherein the liquid receiver further comprises at least one auxiliary sealing component configured to be engaged between the upper case portion and the lower case portion, between the vacuum device and the receiving case and/or between the receiving case and the valve seat of the container.

15. The vacuum product of claim 10, wherein a first cooperating structure is formed on the vacuum device, and a second cooperating structure is formed on the receiving case for cooperating with the first cooperating structure for facilitating assembly of the vacuum device and the liquid receiver.

16. The vacuum product of claim 10, wherein the buoyant assembly comprises a first buoyant component and a second buoyant component detachably assembled with the first buoyant component, the second buoyant component is formed in a circular disc shape, and the first buoyant component comprises a main body portion and at least one extending portion extending from the main body portion and passing through the second buoyant component.

17. The vacuum product of claim 16, wherein the magnetic component is disposed between the first buoyant component and the second buoyant component or at least partially disposed inside the first buoyant component.

18. The vacuum product of claim 16, wherein a guiding structure is formed on the receiving case and configured to cooperate with the at least one extending portion for guiding the buoyant assembly.

19. The vacuum product of claim 10, wherein the vacuum device comprises:

a vacuum pump;

a controller electrically connected to the vacuum pump; and a pressure sensor electrically connected to the controller and for actuating the controller to control the vacuum pump according to a sensing result of the pressure sensor.

20. The vacuum product of claim 10, wherein the liquid receiver further comprises at least one auxiliary sealing component configured to be engaged between the vacuum device and the receiving case and/or between the receiving case and the valve seat of the container.

* * * * *